US010947736B2

(12) United States Patent
Thompson et al.

(10) Patent No.: US 10,947,736 B2
(45) Date of Patent: Mar. 16, 2021

(54) RESIDENTIAL AWNING CANOPY ASSEMBLY

(71) Applicant: CAREFREE/SCOTT FETZER COMPANY, Broomfield, CO (US)

(72) Inventors: Scott Patrick Thompson, Aspen, CO (US); Mark Goth, Loveland, CO (US); Erwin Gaudyn, Broomfield, CO (US)

(73) Assignee: Carefree/Scott Fetzer Company, Broomfield, CO (US)

( * ) Notice: Subject to any disclaimer, the term of this patent is extended or adjusted under 35 U.S.C. 154(b) by 0 days.

(21) Appl. No.: 16/416,942

(22) Filed: May 20, 2019

(65) Prior Publication Data

US 2019/0301166 A1 Oct. 3, 2019

Related U.S. Application Data

(63) Continuation of application No. 16/045,459, filed on Jul. 25, 2018, now Pat. No. 10,316,522, which is a continuation of application No. 15/470,331, filed on Mar. 27, 2017, now abandoned.

(60) Provisional application No. 62/313,336, filed on Mar. 25, 2016.

(51) Int. Cl.
*E04F 10/06* (2006.01)
*E06B 9/46* (2006.01)

(52) U.S. Cl.
CPC ..... *E04F 10/0618* (2013.01); *E04F 10/0633* (2013.01); *E04F 10/0648* (2013.01); *E04F 10/0651* (2013.01); *E04F 10/0662* (2013.01); *E04F 10/0688* (2013.01); *E04F 10/0692* (2013.01); *E06B 9/46* (2013.01)

(58) Field of Classification Search
CPC ..... E04F 10/0618; E04F 10/0648; E04F 10/0651; E04F 10/0688; E04F 10/0692
See application file for complete search history.

(56) References Cited

U.S. PATENT DOCUMENTS

| | | | |
|---|---|---|---|
| 3,722,571 | A | 3/1973 | Knight et al. |
| 4,214,621 | A | 7/1980 | Wessels et al. |
| 4,733,782 | A | 3/1988 | Spezial et al. |
| 5,121,782 | A | 6/1992 | Renkhoff et al. |
| 6,024,152 | A | 2/2000 | Rosenich |
| 6,361,011 | B1 | 3/2002 | Brutsaert |
| 6,383,664 | B2 | 5/2002 | Bernius et al. |
| 6,457,508 | B1 | 10/2002 | Tomita |

(Continued)

*Primary Examiner* — Jessie T Fonseca
(74) *Attorney, Agent, or Firm* — Tarolli, Sundheim, Covell & Tummino LLP; John A. Yirga, Esq.

(57) ABSTRACT

An awning is disclosed. The awning comprises a case assembly comprising a housing, configured to be mounted to a dwelling, and a lead rail, a roller assembly mounted in the case assembly and including a roll tube rotatable relative to the case assembly, a lead rail assembly coupled to the lead rail, the lead rail assembly movable relative to the housing between an extended position and a retracted position, a canopy having a leading edge and a trailing edge, the leading edge being connected to the lead rail assembly and the trailing edge being connected to the roll tube, and a spring arm assembly connecting the housing of the case assembly to the lead rail, the spring arms including a first arm and a second arm pivotable relative to one another, the spring arm assembly allowing the lead rail assembly to move between the extended position and the retracted position.

21 Claims, 27 Drawing Sheets

(56) References Cited

U.S. PATENT DOCUMENTS

| | | | | |
|---|---|---|---|---|
| 6,971,433 | B2 | 12/2005 | Wagner et al. | |
| 2001/0027846 | A1* | 10/2001 | Osinga | E04F 10/0659 160/70 |
| 2003/0192649 | A1 | 10/2003 | Mukai | |
| 2004/0159407 | A1 | 8/2004 | Girard et al. | |
| 2005/0072532 | A1 | 4/2005 | Holden et al. | |
| 2006/0108819 | A1 | 5/2006 | Wagner et al. | |
| 2007/0163722 | A1 | 7/2007 | Wolters et al. | |
| 2007/0193700 | A1 | 8/2007 | Ornelas et al. | |
| 2007/0240832 | A1 | 10/2007 | Cavarec | |
| 2008/0029225 | A1 | 2/2008 | Wagner | |
| 2009/0199974 | A1 | 8/2009 | Liagostera Forns | |
| 2010/0024991 | A1 | 2/2010 | Thompson et al. | |
| 2010/0126544 | A1 | 5/2010 | Wagner et al. | |
| 2010/0258252 | A1 | 10/2010 | Brutsaert | |
| 2011/0048651 | A1 | 3/2011 | Goth | |
| 2014/0251552 | A1 | 9/2014 | Ma | |
| 2015/0167308 | A1 | 6/2015 | Thompson et al. | |
| 2017/0356214 | A1 | 12/2017 | Tsai et al. | |

* cited by examiner

RESIDENTIAL AWNING CANOPY ASSEMBLY

CROSS-REFERENCE TO RELATED APPLICATIONS

The present application is a continuation application claiming priority under 35 U.S.C. § 120 to U.S. nonprovisonal application Ser. No. 16/045,459 that was filed on Jul. 25, 2018 and published on Jan. 10, 2019 under publication number US 2019-0010707 entitled RESIDENTIAL AWNING CANOPY ASSEMBLY which claimed priority under 35 U.S.C. § 120 to U.S. nonprovisonal application Ser. No. 15/470,331 that was filed on Mar. 27, 2017 and published on Sep. 28, 2017 under publication number US 2017-0275884 entitled RESIDENTIAL AWNING CANOPY ASSEMBLY which claims priority under 35 U.S.C. § 119(e) to U.S. Provisional Patent Application Ser. Nos.:

62/313,329 filed Mar. 25, 2016 entitled RESIDENTIAL AWNING CANOPY ASSEMBLY; and

62/313,336 filed Mar. 25, 2016 entitled AWNING CANOPY WALL ATTACHMENT ASSEMBLY;

All of the above-identified applications and publications are incorporated herein by reference in their entireties for all purposes.

FIELD OF THIS DISCLOSURE

The present disclosure relates to a residential awning canopy assembly, and more particularly an autonomous motorized shade for windows.

BACKGROUND

An awning is a welcome addition to a house, recreational vehicle, or other dwelling. The awning typically provides increased enjoyment of an outdoor area surrounding the dwelling. The awning can cast a shaded area that creates an escape from direct sunlight, thereby providing a space in which an occupant of the dwelling may relax. The shaded area created by the awning contributes to the relaxation of the occupant in that there is a perceived decrease in temperature and, thus, generally becomes more comfortable. The awning as well advantageously protects occupants underneath from precipitation. As illustrated in the prior art depicted in FIG. 1, traditional awning assemblies 10 have multi-component arm connectors 60 that are spaced from lateral edges 52, 54 of a traditional lead rail 50, making the arm connectors prominent in the field of view of a user. The traditional assembly 10 allows the arm connectors 60 to both translate and rotate at all four connection points 62. Arrows A illustrate the direction of the translation of the arm connectors 60 along the respective rails the closing of the assembly. While it should be appreciated that the opening would result in translation in the direction opposite the direction of arrows A and rotation in an opposite direction of the arm connectors from the closing rotation direction.

Known awning structures generally consist of a base 24 that is permanently affixed to the dwelling, and a canopy 42 that is removably attached to the base. Conventional awning structures are discussed in detail further in U.S. Pat. No. 6,971,413 assigned to Carefree/Scott Fetzer Company, U.S. Pat. No. 6,971,433 is incorporated herein by reference in its entirety for all purposes and attached hereto as an Appendix and part of this provisional application. Conventional motor driven awning structures are discussed in detail further in U.S. Pat. No. 8,960,256 assigned to Carefree/Scott Fetzer Company. U.S. Pat. No. 8,960,256 is incorporated herein by reference in its entirety for all purposes.

SUMMARY

A first aspect of the present disclosure includes an awning comprising a case assembly comprising a housing and a lead rail, the housing configured to be mounted to a dwelling, a roller assembly mounted in the case assembly and including a roll tube rotatable relative to the case assembly, a lead rail assembly coupled to the lead rail, the lead rail assembly movable relative to the housing of the case assembly between an extended position and a retracted position, a canopy having a leading edge and a trailing edge, the leading edge being connected to the lead rail assembly and the trailing edge being connected to the roll tube and a spring arm assembly connecting the housing of the case assembly to the lead rail, the spring arms including a first arm and a second arm pivotable relative to one another, the spring arm assembly allowing the lead rail assembly to move between the extended position and the retracted position.

A second aspect of the present disclosure includes an awning system comprising a roll bar coupled to a motor and a torsion spring, said motor comprising a one-way drive mechanism. The awning system further comprising a canopy comprising a first end and a second end, the first end coupled to the roll bar and the second end coupled to a lead rail. The awning system further includes first and second spring arms movably coupling the roll bar to the lead rail, wherein the first and second spring arms support the lead rail between an extended position and a retracted position and first and second gas springs are coupled to the first and second spring arms, respectively. The first and second gas spring bias the lead rail toward the extended position by applying a first force to the lead rail. Wherein the torsion spring biases the lead rail toward the retracted position by applying a second force to the lead rail via the canopy. The first three is greater than the second three. Wherein, the motor, absent actuation of said motor in an unwinding direction, prevents the roll bar from unwinding and the awning from extending via the one-way drive mechanism. Wherein responsive to being actuated in a winding direction, opposite the unwinding direction, the motor applies a roll bar force to the roll bar in the winding direction via the one-way drive mechanism that extends the canopy, wherein the roll bar force in conjunction with the second force is greater than the first force. Responsive to being actuated in the unwinding direction, the motor regulates a rate of extension of the canopy via the one-way drive mechanism while the first force of the first and second gas springs extends the canopy.

A third aspect of the present invention includes an awning mounting kit comprising an awning and an anchor. The awning comprising a roll bar coupled to a canopy. The roll bar housed within a housing having a first end and a second end. The canopy extends out a front face of said housing. The housing further comprising first and second lateral slots extending along a rear face of the housing between and spaced from the first and second ends of the housing. The first and second lateral slots extend parallel to the roll bar, wherein the first slot comprises a recess and the second slot comprises a spring loaded retainer. The anchor is configured to mount the awning to a dwelling, the anchor having a long portion to be secured to the dwelling and a short portion comprising a latch. The long portion terminating in a mounting hook. The latch being configured to be received in the second slot and the mounting hook being configured to be received in the first slot. The latch configured to interface with the spring loaded retainer to lock the awning to the anchor, wherein the first slot is configured to rest upon and be rotatably coupled to the mounting hook, and wherein the second slot is configured to accept the latch as the awning is being rotated toward the anchor via the mounting hook in the first slot. Wherein the interaction of the latch and the spring loaded retainer is configured to cause the spring loaded retainer to rotate about a pivot point to an open position allowing the latch to pass under a hooked portion of the spring loaded retainer. The spring loaded retainer is configured to return to a resting position having retained the latch via the hooked portion.

A fourth aspect of the present invention includes an awning canopy mounting system, the system comprising a canopy having a leading edge and a trailing edge, wherein the leading edge of the canopy is provided with a first female mounting member and the trailing edge of the canopy is provided with a second female mounting member. The system further comprises a roll tube provided with a first male mounting member, the first male mounting member engaging the first female mounting member to secure the trailing edge to the roll tube, wherein the first female mounting member is uncoupleable from the male mounting member via the application of an unsnapping force. The system additionally comprises a lead rail assembly provided with a second male mounting member, the second male mounting member engaging the second female mounting member to secure the leading edge to the lead rail assembly, wherein the second female mounting member is uncoupleable from the second male mounting member via the application of a second unsnapping force. Further wherein, the roll bar and the lead rail comprise first and second projections that overlap the first and second male mounting members at first and second notches of the first and second female mounting members, respectively.

A fifth aspect of the present invention includes an awning control system comprising an awning and an awning control system. The awning comprising at least one of a roll bar coupled to a motor, a canopy coupled to the roll bar and a housing, the housing configured to be attached to a dwelling, and arms coupled to the roll bar, configured to move the awning between an extended and retracted position, or the roll tube, housed in the housing, coupled to a first end of the canopy and coupled to the motor, a lead rail coupled to a second end of the canopy, the lead rail movable relative to the housing between the extended position and the retracted position, and an arm assembly connecting the housing to the lead rail, the arm assembly allowing the lead rail assembly to move between the extended position and the retracted position. The status monitoring system comprising a processor and a transceiver, the status monitoring system is in electrical communication with the motor. The status monitoring system is configured to monitor an awning position and conditions around the awning and control a position of the awning between the extended and retracted positions. The status monitoring system having at least one sensor, wherein the sensor comprises at least one of an accelerometer, a light sensor, a temperature sensor, and a wind speed sensor. The at least one sensor communicating detected information to the status monitoring system during use. The transceiver for at least one of sending said detected information to a user on a secondary device and receiving executable instructions about the extension or retraction of the awning from said secondary device.

A sixth aspect of the present invention includes an awning support structure comprising a spring arm assembly configured to connect a housing to a lead rail, wherein the lead rail assembly is connected to a leading edge of a canopy. The lead rail movable relative to the housing between an extended position and a retracted position. A trailing edge of the canopy is connected to a roll tube housed in the housing. The spring arms assembly comprising at least a first spring arm. The first spring arm comprising a first arm comprising integrally formed first and second end pivots and a first spring hook, a second arm pivotable relative to the first arm, wherein the second arm includes integrally formed third and fourth end pivots and a second spring hook, wherein the third end pivot is rotatably coupled to the second end pivot. Wherein the first end pivot is configured to be rotatably coupled to the housing, the fourth end pivot is configured to be rotatably coupled to the lead rail, and wherein the first and second spring hooks are configured to couple to first and second ends of a gas spring.

A seventh aspect of the present invention includes an awning support structure comprising a spring arm assembly. The spring arm assembly comprising a first arm having a first end and a second end, a second arm having a first end and a second end, the second end of the first arm pivotably connected to the first end of the second arm, a proximal end cap is pivotably connected to the first end of the first arm, and configured to removably connect to a housing, and a distal end cap is pivotably connected to the second end of the second arm, and configured to removably connect to a lead rail. Wherein the lead rail is connected to a leading edge of a canopy, the lead rail movable by the spring arm assembly relative to the housing between an extended position and a retracted position, a trailing edge of the canopy is connected to a roll tube housed in the housing.

BRIEF DESCRIPTION OF THE SEVERAL VIEWS OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals, unless otherwise described refer to like parts throughout the drawings and in which.

Figure 1:
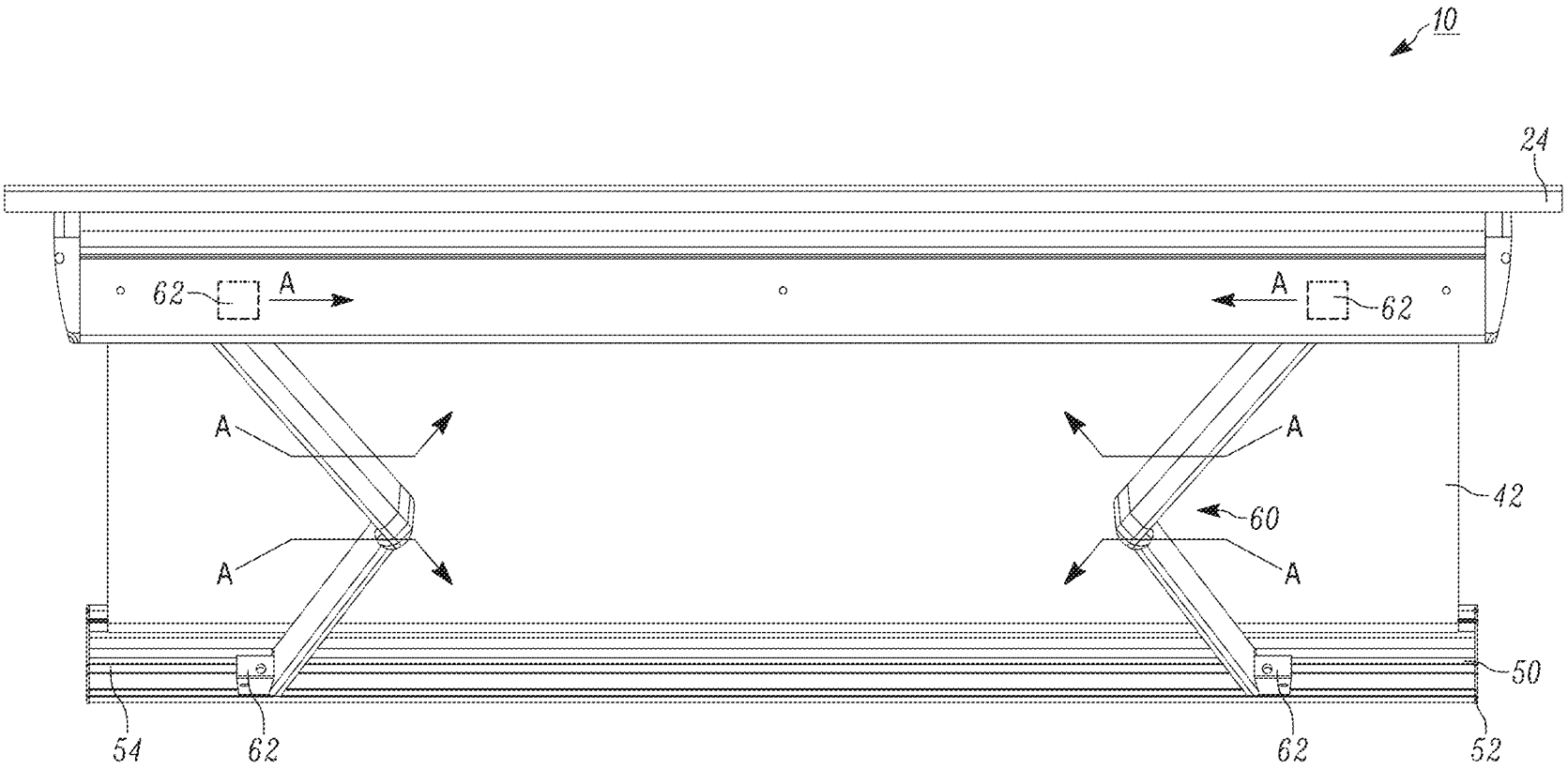
PRIOR ART FIG. 1
FIG. 1 is a perspective view of a traditional awning assembly.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The apparatus components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Referring now to the figures generally wherein like numbered features shown therein refer to like elements having similar characteristics and operational properties throughout unless otherwise noted. The present disclosure relates to a residential awning canopy assembly, and more particularly an autonomous motorized shade for windows that is locally powered.

Figure 2A:
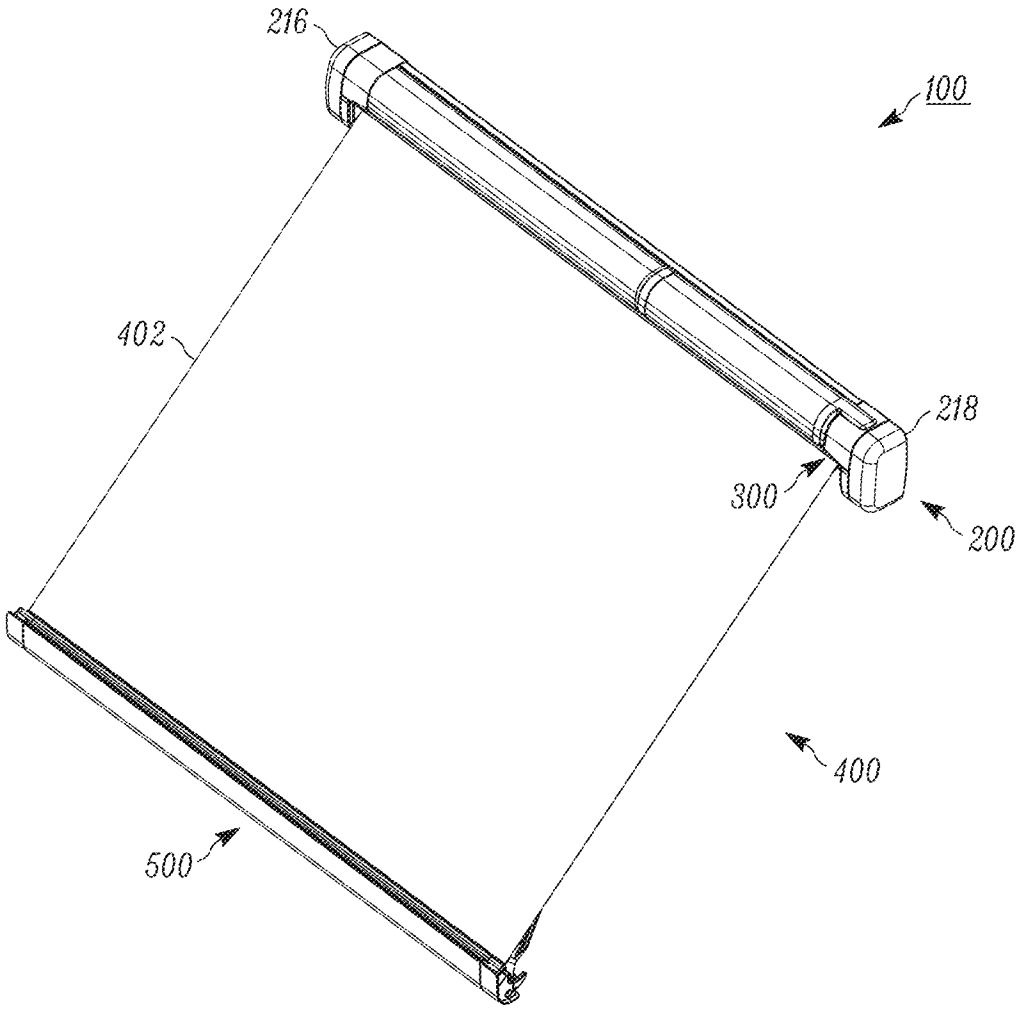
FIG. 2A is a perspective view of an awning in accordance with a first example embodiment of the present disclosure in an extended position.

An awning 100 according to one example embodiment of the present invention is illustrated in FIG. 2A. As illustrated generally in FIGS. 2A-2B, the awning 100 includes a case assembly 200 that mounts the canopy 402 to a dwelling (e.g., house, recreational vehicle, etc.). The case assembly 200 receives a roller assembly 300 around which a canopy assembly 400 can be wound. A lead rail 500 assembly is connected to the case assembly 200 by a pair of spring arm assemblies 600. The awning 100 can be moved between art extended position (see, for example FIG. 2A) and a retracted position (see, for example, FIG. 4A).

In the extended position, the lead rail assembly 500 is spaced apart from the case assembly 200 and a canopy 402 of the canopy assembly 400 is unwound from the roller assembly 300 to provide a shaded area. In the retracted position, the lead rail assembly 500 abuts against the case assembly 200 to form an enclosed, compact housing and the canopy 402 is wound onto the roller assembly 300.

Referring to FIGS. 2B and 4A-6B, details of the case assembly 200 are shown. The case assembly 200 includes a housing 202 and an anchor 204. As seen in the illustrated example embodiment of FIGS. 4B and 5, the anchor 204 is adapted to be fastened to the dwelling and has an L-shaped cross section that includes a long portion 206 and a short portion 208. The long portion 206 is provided with a plurality of apertures 210 that are spaced along a longitudinal axis LA of the anchor 204. A distal end 205*a* of the long portion 206 is provided with a mounting hook 212 that extends the length of the anchor 204 along the longitudinal axis LA. The short portion 208 extends at least one of transversely or perpendicularly to the long portion 206. A distal end 207*a* of the short portion 208 is provided with a latch 214 that extends the length of the anchor 204 along the longitudinal axis LA. A proximal end 205*b* of the long portion 206 is coupled to the proximal end 207*b* of the short portion 208.

Figure 3:
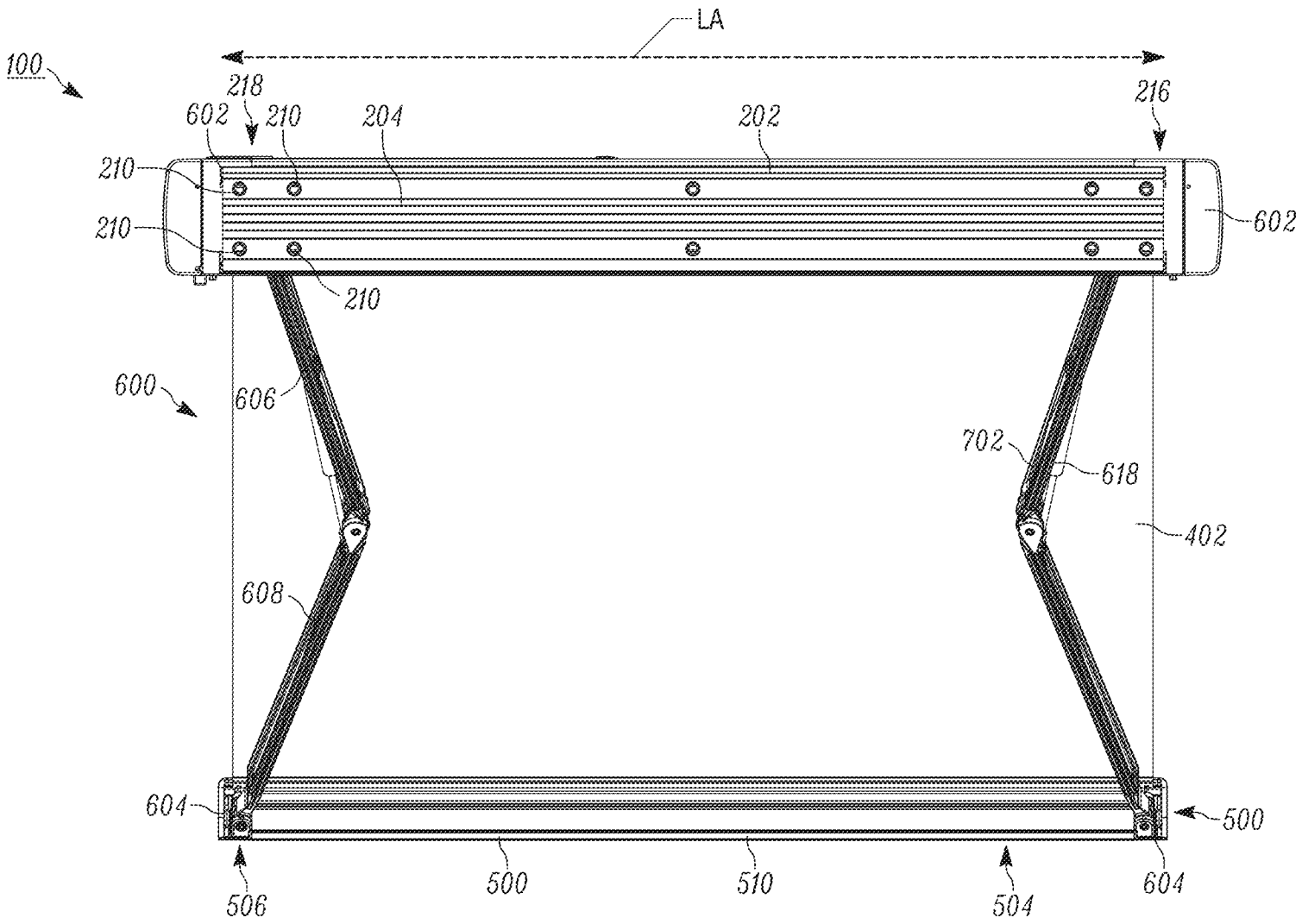
FIG. 3 is a bottom view of the awning of FIG. 2A.

The housing 202, when coupled to the anchor 204, extends along the longitudinal axis LA between a first end 216 and a second end 218 (see FIG. 3). The housing 202 is provided with a front face 220 and a rear face 222 (see FIGS. 6A-6B) that each extend between the first end 216 and the second end 218. The front face 220 has an opening 224. The rear face 222 is provided with a first slot 226 and a second slot 228. A termination location of the first slot 226 and the second slot 228 are spaced from the first end 216 and the second end 218 of the housing 202, respectively. A spring loaded retainer 230 (see FIGS. 6A-6F) is provided in the second slot 228. The housing 202 defines a space in which the roller assembly 300 is received via the opening 224 on the front face 220.

Referring to FIGS. 7A-9C, details of the roller assembly 300 are shown. The roller assembly 300 is rotatably mounted in the housing 202. The roller assembly 300 includes a roll tube 302 that extends along the longitudinal axis LA between a first end 304 and a second end 306 when assembled within the housing 202 (see FIG. 7A).

Figure 8A:
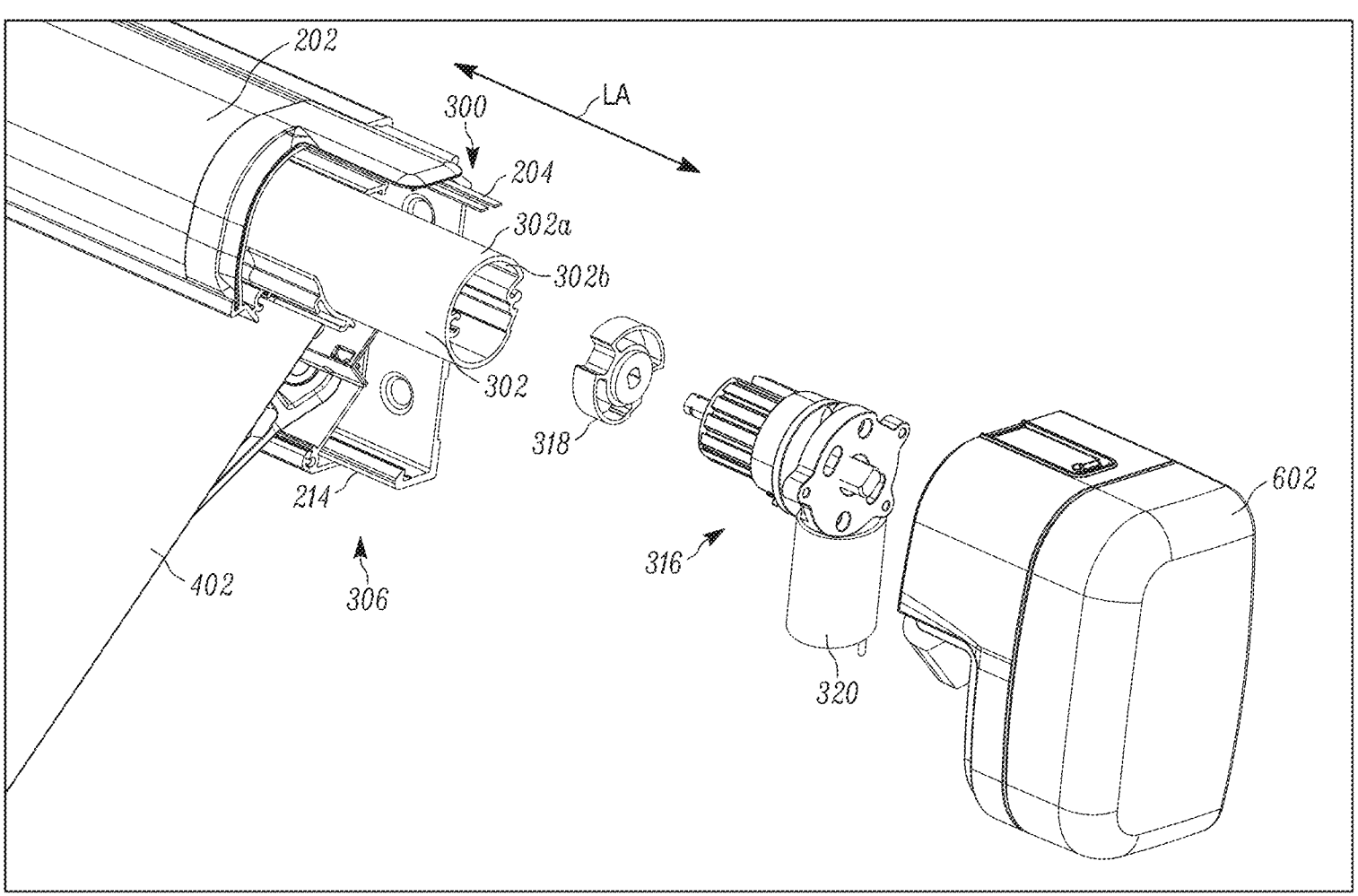
FIG. 8A is a perspective view of part of the awning of FIG. 2A showing details of a drive assembly.
Figure 8B:
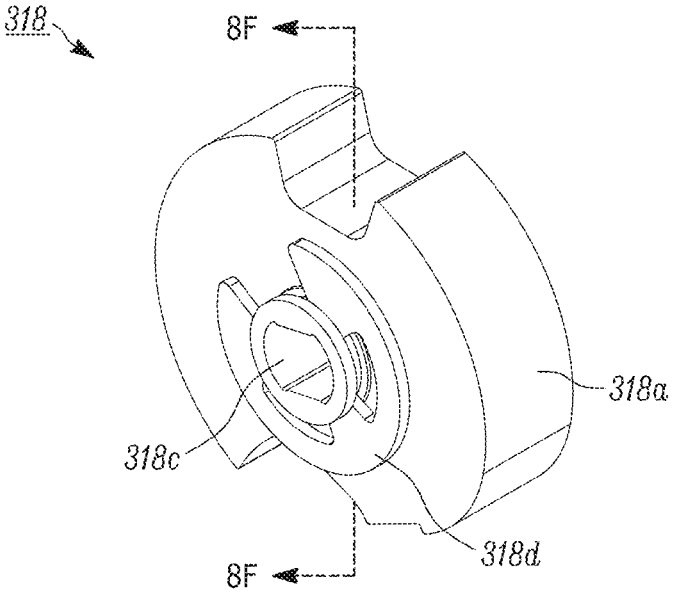
FIG. 8B is a front perspective view of the one-way drive mechanism of FIG. 8A.
Figure 8C:
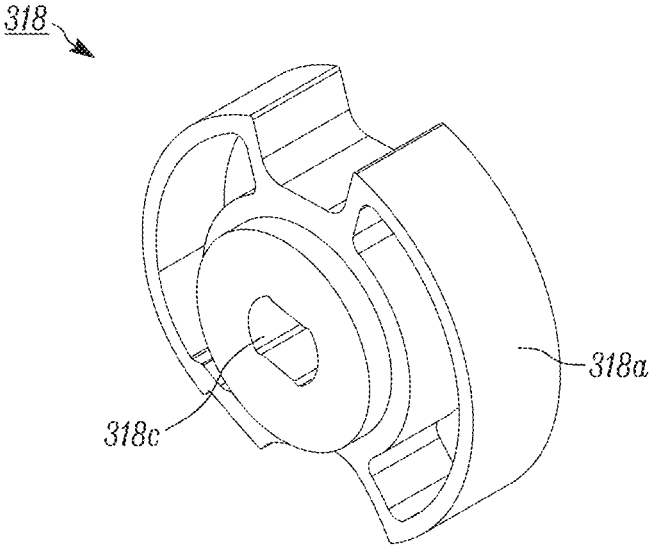
FIG. 8C is a rear perspective view of the one-way drive mechanism of FIG. 8A.
Figure 8D:
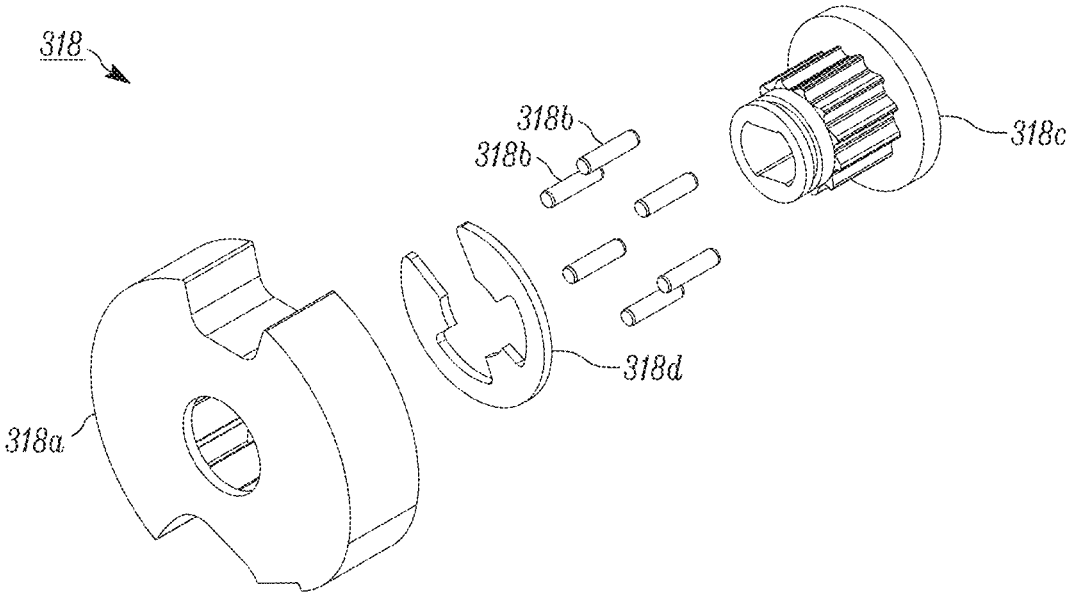
FIG. 8D is an exploded front perspective view of the one-way drive mechanism of FIG. 8A.
Figure 8E:
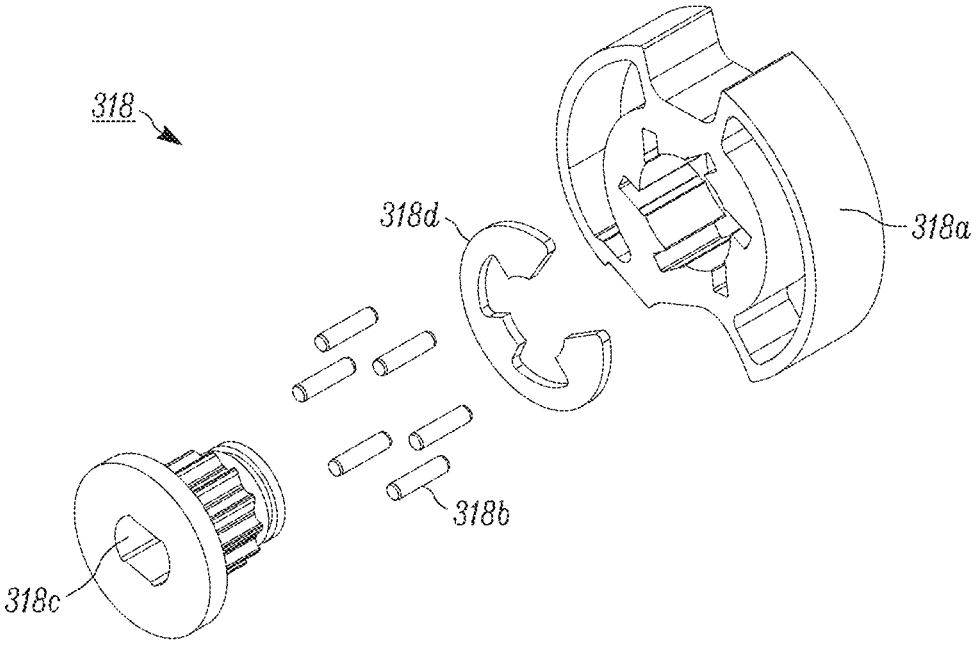
FIG. 8E is an exploded rear perspective view of the one-way drive mechanism of FIG. 8A.
Figure 8F:
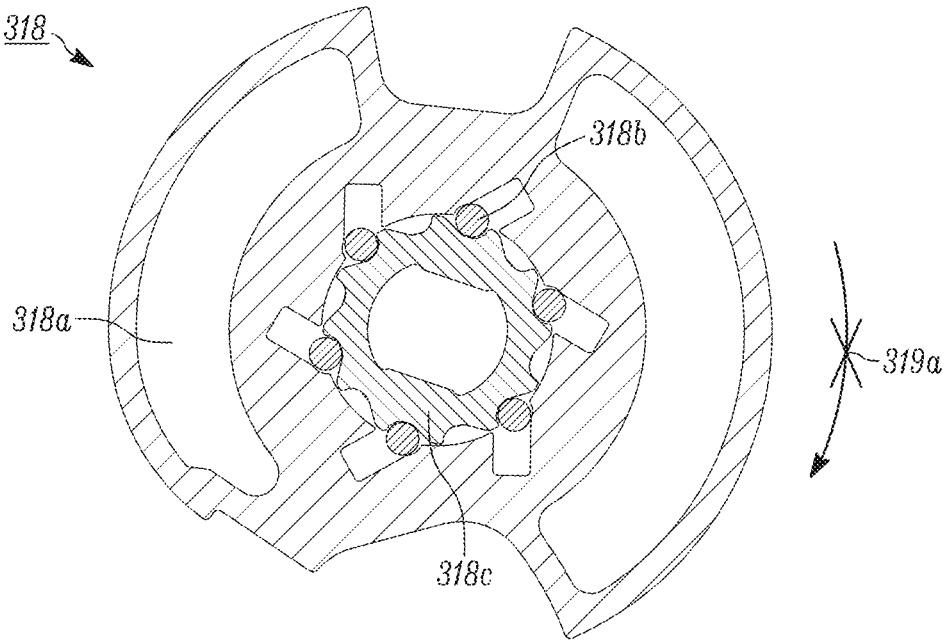
FIG. 8F is a cross-section taken along lines 8F-8F of FIG. 8B of a locked one-way drive mechanism.
Figure 8G:
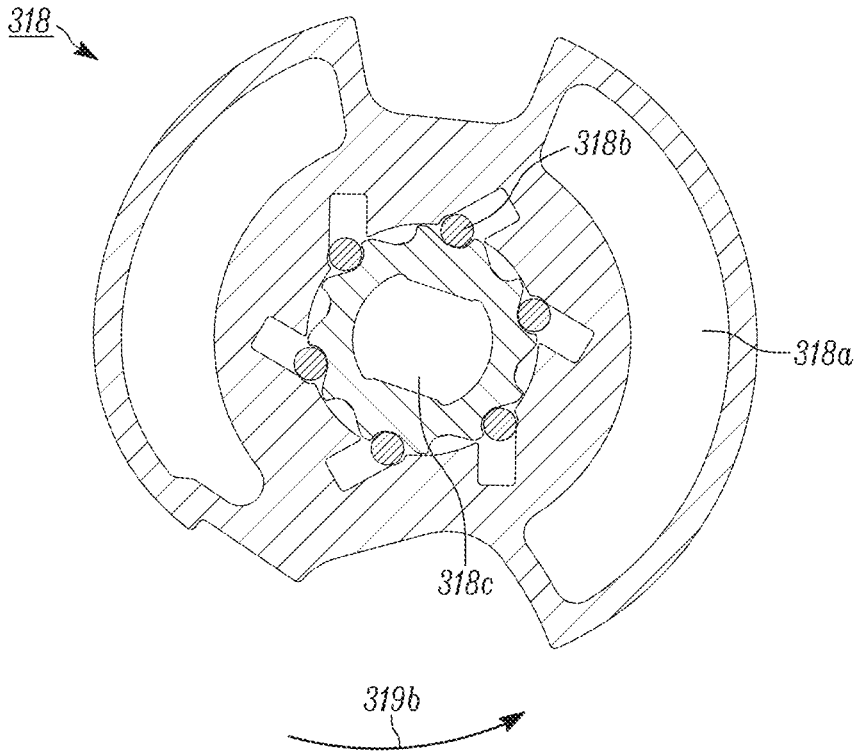
FIG. 8G is a cross-section taken along lines 8F-8F of FIG. 8B of an unlocked one-way drive mechanism.
Figure 9A:
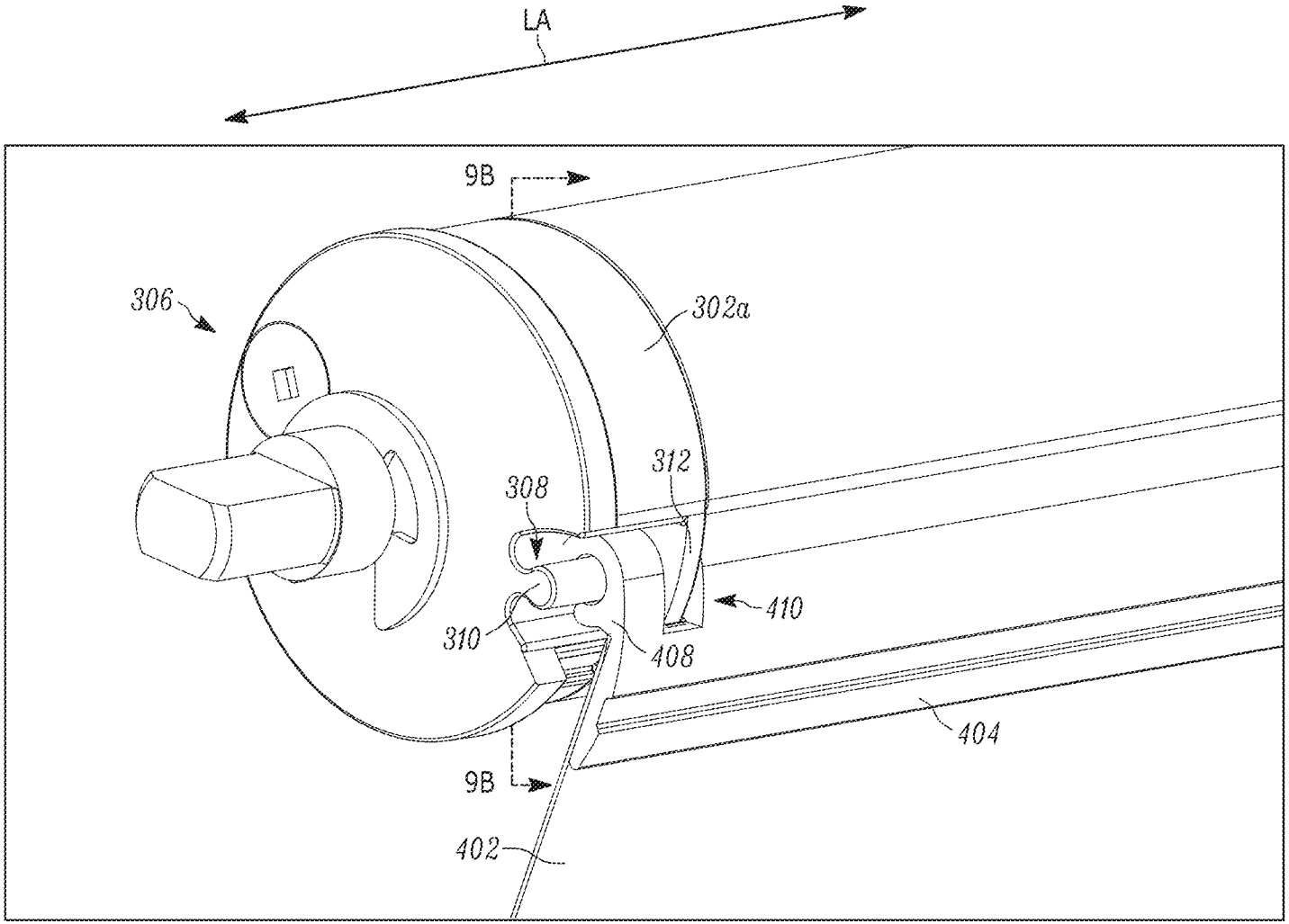
FIG. 9A is a perspective view of part of the awning of FIG. 2A showing details of a roll tube and a canopy.
Figure 9B:
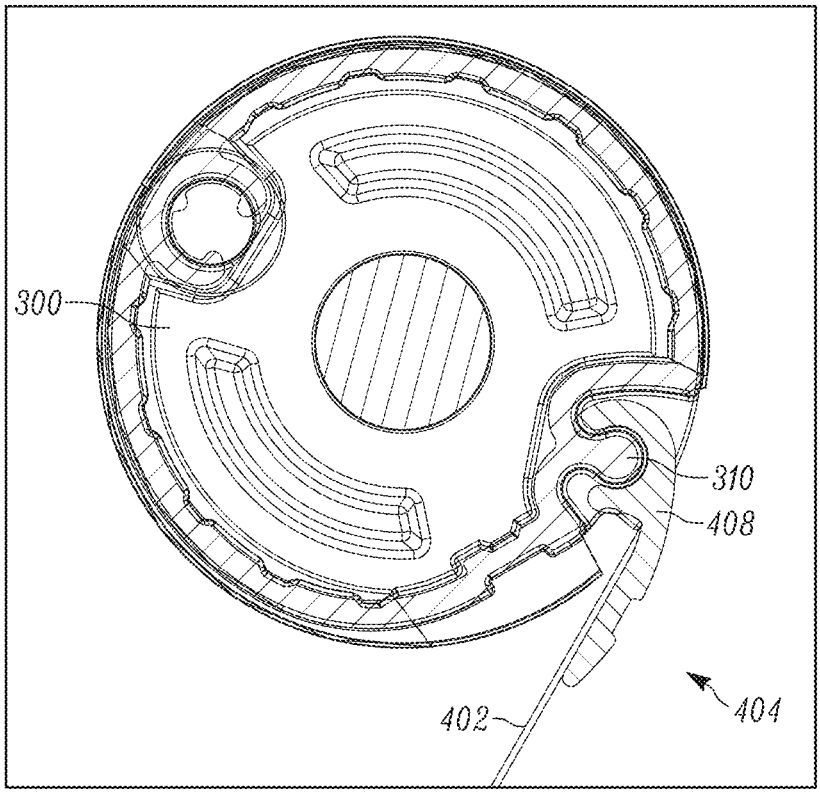
FIG. 9B is a cross-sectional view taken along lines 9B-9B of FIG. 9A.
Figure 9C:
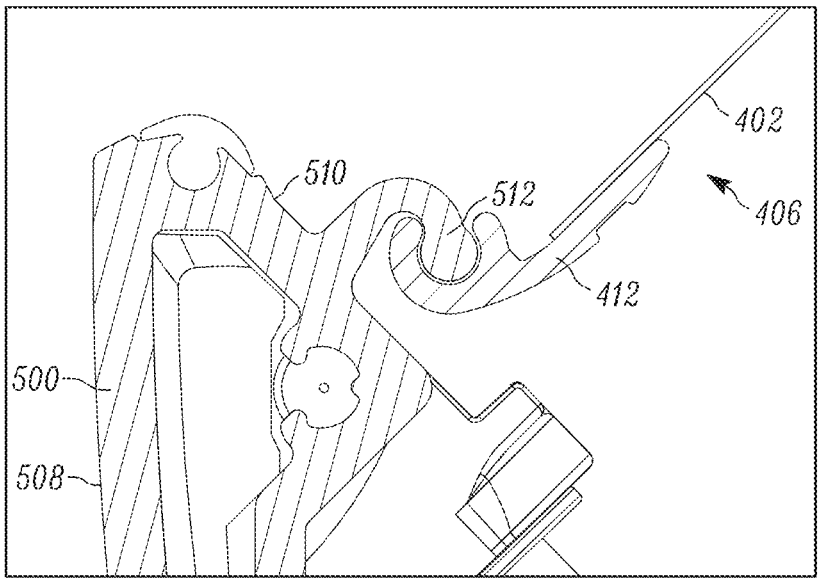
FIG. 9C cross-sectional view taken along lines 9C-9C of FIG. 7A.

An external surface 302*a* of the roll tube 302 is provided with a recess 308 in which a roll tube male mounting member 310 is provided (see FIG. 9A). The recess 308 and the roll tube male mounting member 310 extends substantially along the length of the roll tube 302. First projections 312 are provided toward the first and second ends 304, 306 of the roll tube male mounting member 310. A torsion spring 314 (see FIG. 7B) is received in the first end 304 of the roll tube 302. The torsion spring 314 is secured to an interior surface 302*b* of the roll tube 302 and extends along the longitudinal axis LA. The torsion spring 314 is arranged to provide a rotational torque to the roll tube 302 in a winding direction, that is, a direction that will wind the canopy 402 around the roll tube to a closed position. A drive assembly 316 is provided at the second end 306 of the roll tube 302 (see FIG. 8A). The drive assembly 316 includes a one-way drive mechanism 318 that is selectively fixed to the interior surface 302*b* of the roll tube 302 (e.g. the one-way drive mechanism engages the roll tube when the roll tube rotates in the winding direction, but uncouples from the roll tube when the roll tube rotates in an unwinding direction). The drive assembly 316 further includes a motor 320 that is arranged to rotatably drive the one way drive mechanism 318 about the longitudinal axis LA of the roll tube 302. Power can be provided to the motor 320 via a battery that is recharged by solar panels, a hardwire connection, or any other suitable power source. In one example embodiment, such as when direct sunlight is readily available, solar panels function as a power source. In another example embodiments, the solar panels supply power to be stored in a battery. In another example embodiment, an auxiliary input connects to an additional solar panel or wall transformer power source to keep the battery charged when the awning 100 is installed in a location that receives sunlight below a threshold needed to charge the battery. In yet another example embodiment, the awning 100 is hard wired to a power source, such as to the power source of the dwelling. In one example embodiment, the solar panels function as a light sensor 704 (see FIG. 12).

Figure 2B:
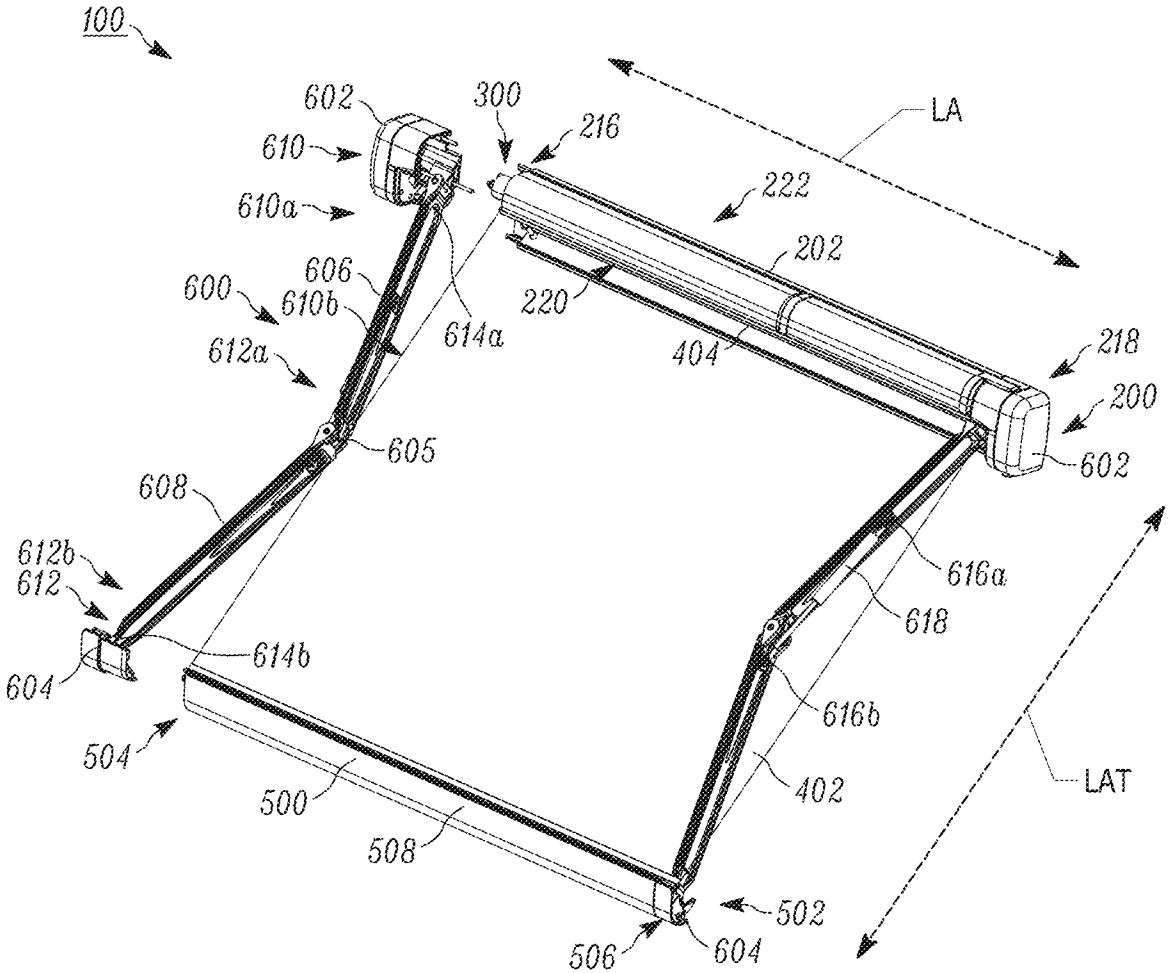
FIG. 2B is a perspective partially exploded view of the awning of FIG. 2A.
Figure 10:
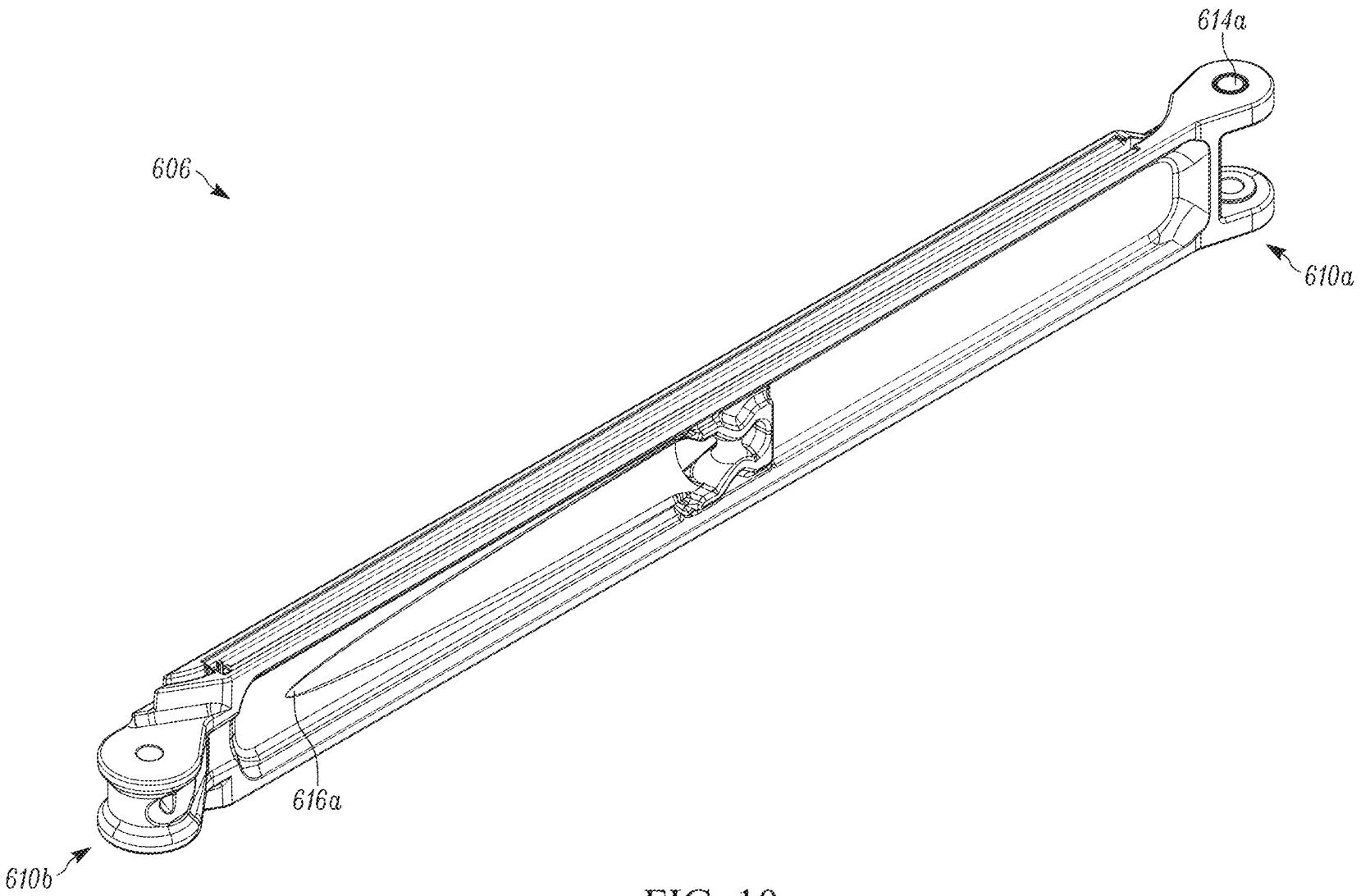
FIG. 10 is a perspective view of part of the awning of FIG. 2A showing details of a portion of an arm.
Figure 11:
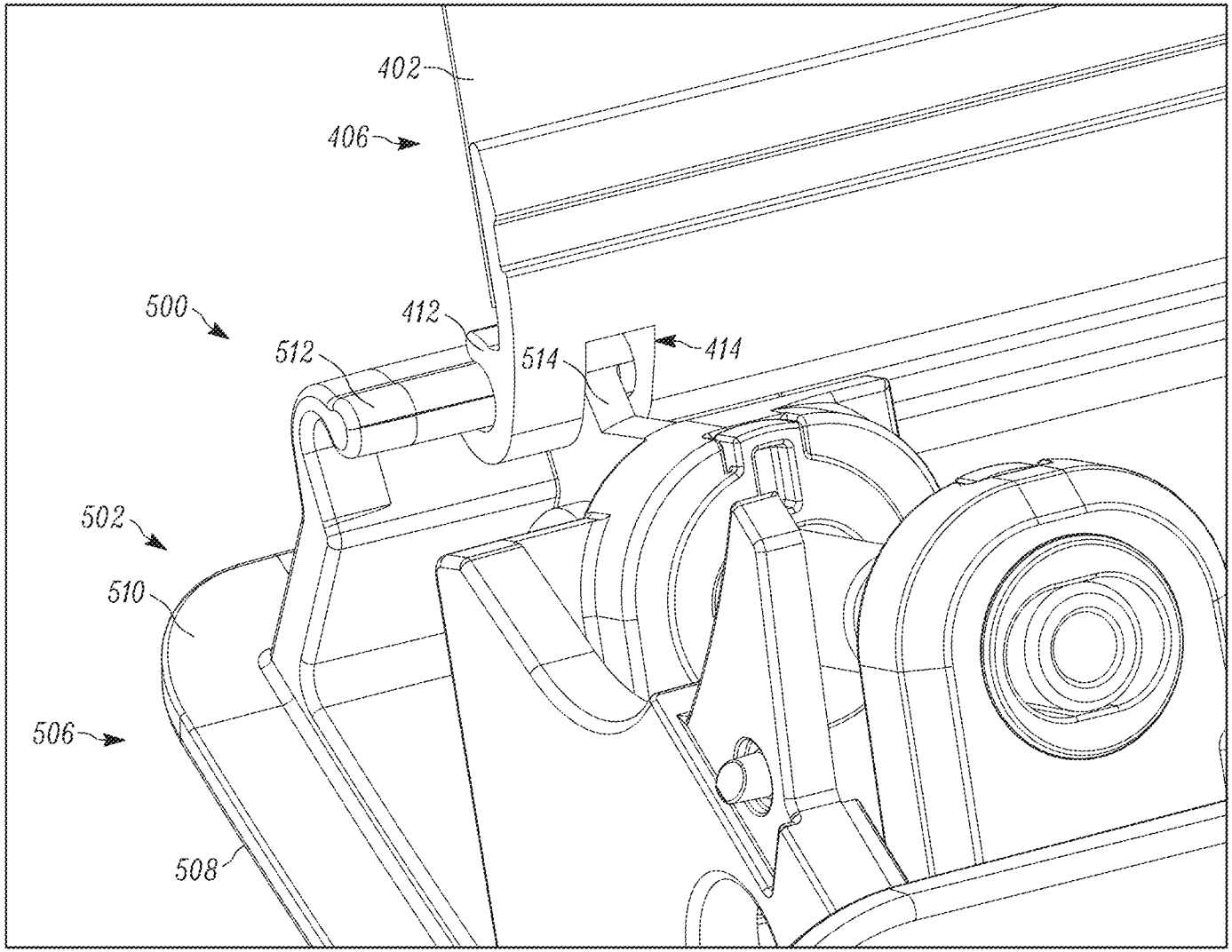
FIG. 11 is a perspective view of part of the awning of FIG. 2A showing details of a lead rail assembly and a canopy.

Referring to FIGS. 2B, 3, and 10, details of the spring arm assemblies 600 are shown. Each spring arm assembly 600 includes a proximal end cap 602, a distal end cap 604, a first arm 606, and a second arm 608. The first and second arms 606, 608 are connected via a first joint 605. The first and second arms 606, 608 each extend along a lateral axis LAT when extended between a first end 610 and a second end 612 of the spring arm assembly 600. End pivots 614*a*-614*b* are provided at the first and the second ends 610, 612, respectively. At least one spring hook 616*a*-616*b* is provided between the first end 610 and the second end 612. The end pivots 614*a*-614*b* and the spring hooks 616*a*-616*b* are integrally formed with the respective spring arms 606, 608. A first end 610*a* of the first arm 606 is pivotably attached to the proximal end cap 602 via the end pivot 614*a*. A second end 612*a* of the second arm 608 is pivotably attached to the distal end cap 604 via the end pivot 614*b*. A second end 610*b* of the first arm 606 and a first end 612*a* of the second arm 608 are pivotably attached to one another via a first joint 605. In one example embodiment, a gas spring 618 is secured at opposite ends to the spring hook 616*a* of the first anti 606 and the spring hook 616*b* of the second arm 608. The gas spring 618 is arranged to move linearly between a retracted position and an extend position when the first arm 606 and the second arm 608 pivot relative to one another about the joint 605, and the end pivots 614*a*, 614*b* at the first and second ends 610, 612, respectively. The respective arms 606, 608 of the spring arm assembly 600 bend toward each other when retracting. In one example embodiment, the respective arms 606, 608 bend along a plane transverse or parallel to the longitudinal axis LA to a closed position.

Additionally, the gas spring 618 is arranged to bias the first and second arms 606, 608 such that the first end 612*a* of the second arm 608 is spaced apart from the second end 610*b* of the first arm 606 (i.e., biasing the awning toward the extended position). The gas spring 618 can be damped such that the rate at which the gas spring 618 extends can be controlled. The first proximal end cap 602 is attached to a terminal end of the housing 202 at the first end 216 of the housing. The torsion spring 314 (see FIG. 7B) is secured to, and partially housed by, the first proximal end cap 602. The second proximal end cap 602 is attached to the terminal end of the housing 202 at the second end 218 of the housing. The drive assembly 316 is partially housed in the second proximal end cap 602.

Figure 4A:
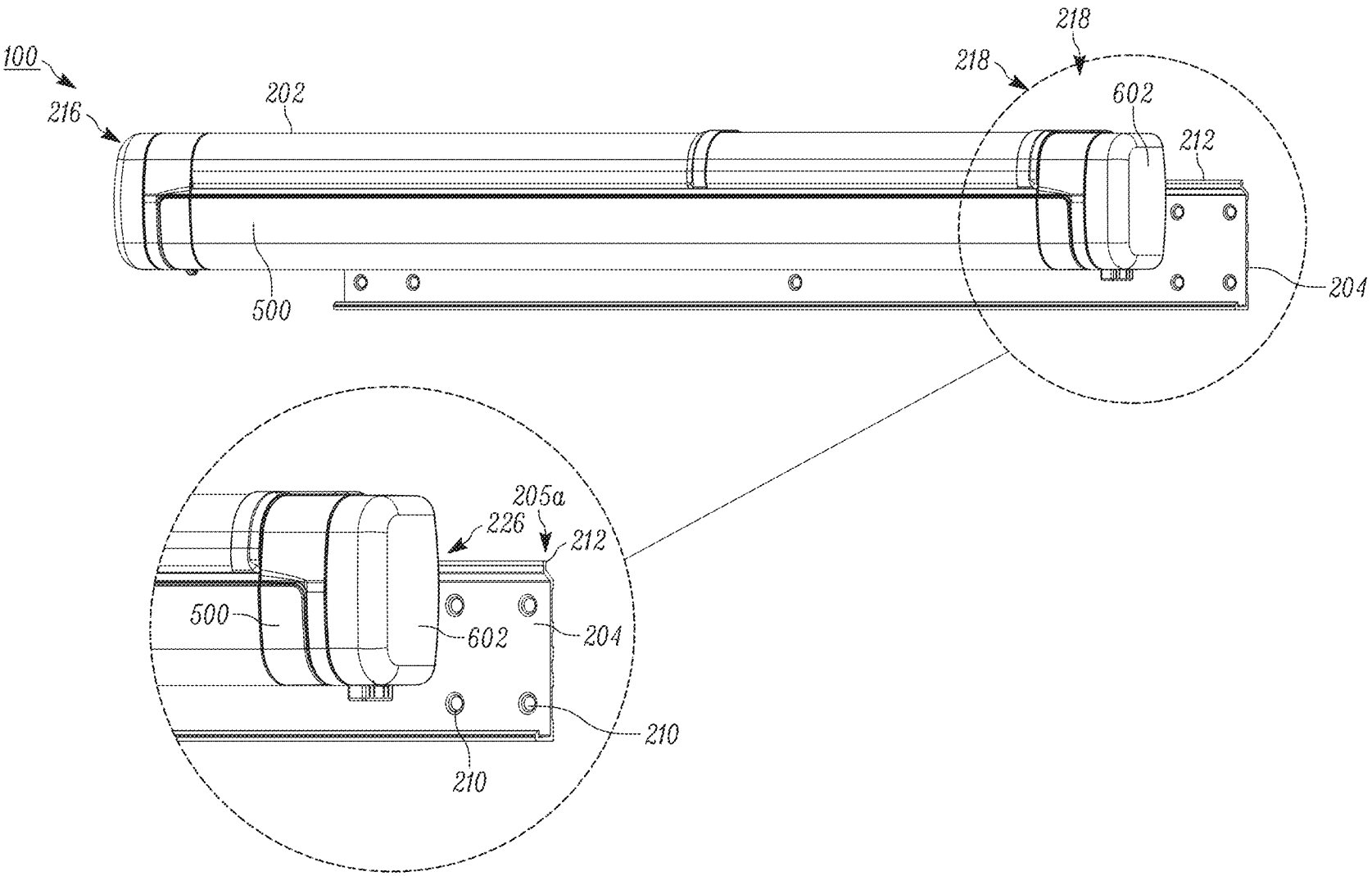
FIG. 4A is a perspective view of the awning of FIG. 2A in a retracted position and showing details of an anchor.
Figure 4B:
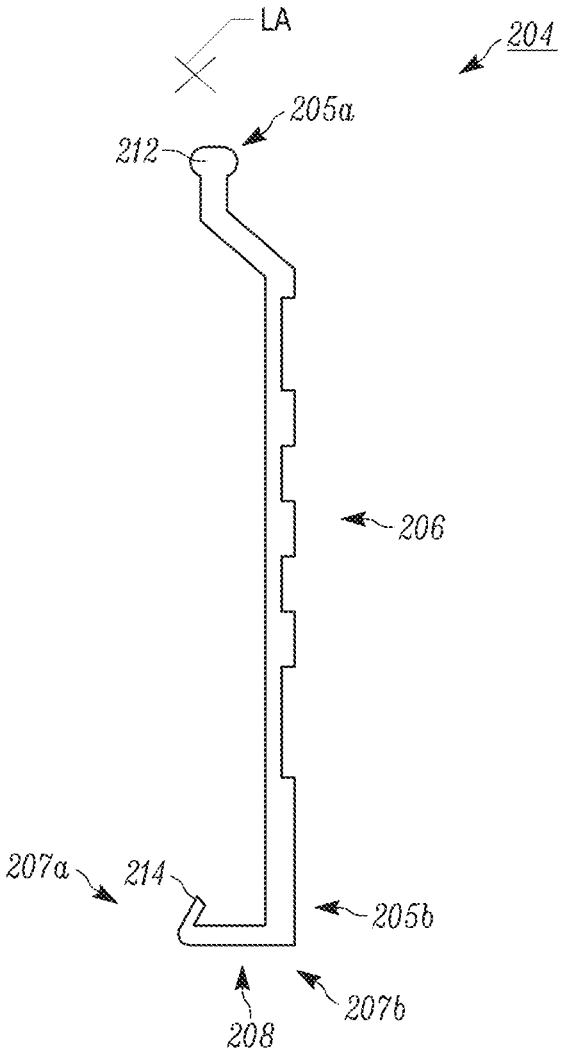
FIG. 4B is a side elevation view of the anchor of FIG. 4A.
Figure 5:
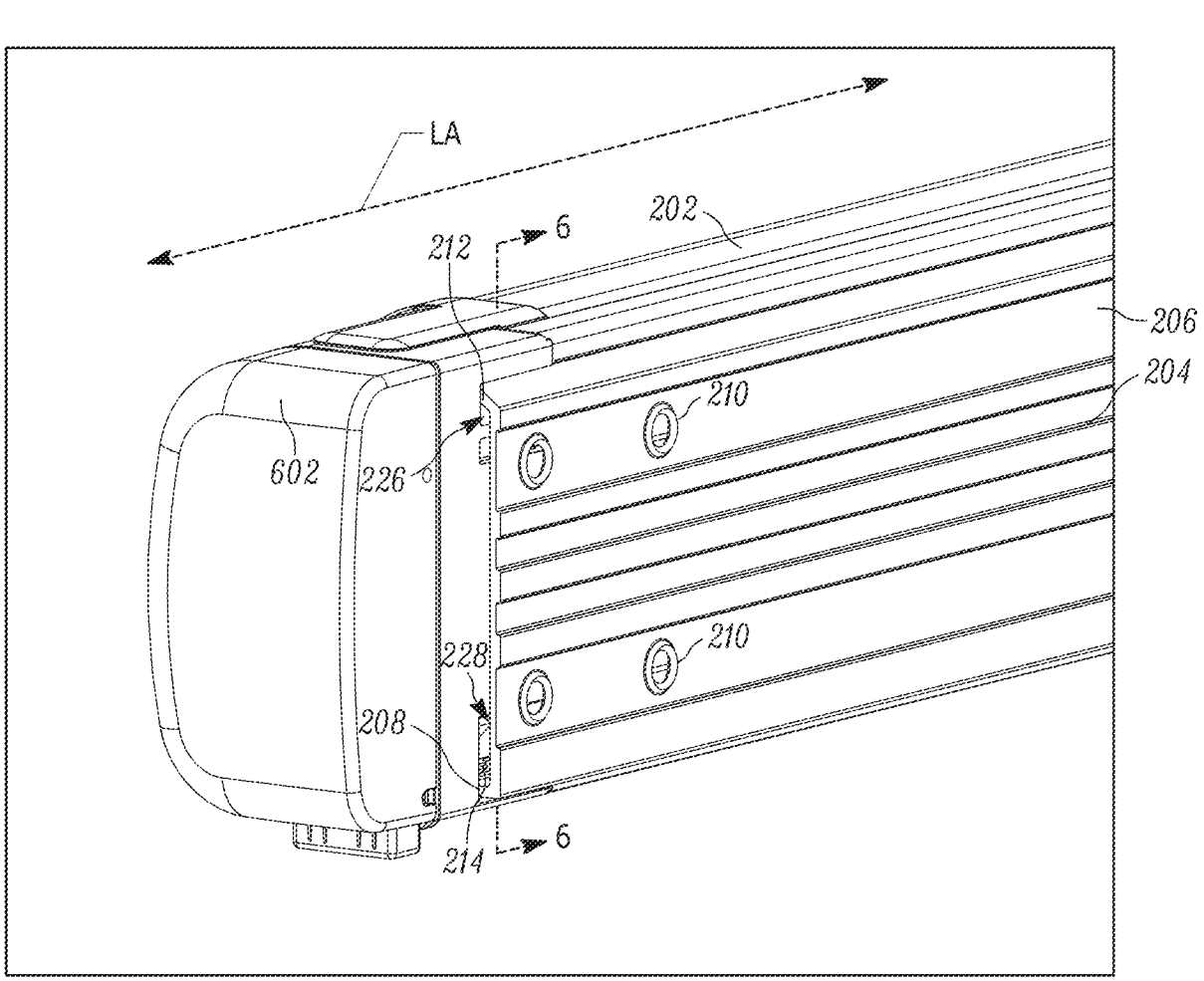
FIG. 5 is a rear perspective view of the awning of FIG. 2A showing further details of the anchor.

Referring to FIGS. 2B, 6A, 6B, 9C, and 11, details of the lead rail assembly 500 are shown. The lead rail assembly 500 includes a lead rail 502 that extends along or transverse to a lateral axis LAT between a first end 504 and a second end 506. The first distal end cap 604 is attached to the terminal end of the lead rail 502 at the first end 504 of the lead rail 502. The second distal end cap 604 is attached to the terminal end of the lead rail 502 at the second end 506 of the lead rail. Thus, the spring arm assemblies 600 attach the lead rail assembly 500 to the housing 202 for movement relative, to the housing between the extended position (e.g., as illustrated in FIG. 2B) and the retracted position (e.g., as illustrated in FIG. 4A). The lead rail 502 includes a front face 508 and a rear face 510 that each extend between the first end 504 and the second end 506. The rear face 510 of the lead rail is provided with a lead rail male mounting member 512 (see FIG. 9C). The lead rail male mounting member 512 extends substantially along the length of the lead rail 502. Second projections 514 (see FIG. 11) are provided at the ends of the lead rail mounting member 512.

Referring to FIGS. 2B, 9A-9C, and 11, details of the canopy assembly 400 are shown. In one example embodiment, the canopy assembly 400 includes a substantially rectangular shaped canopy 402. In another example embodiment, the canopy assembly 400 includes other geometrically shaped canopies 402. The canopy 402 includes a trailing edge 404 and a leading edge 406. The trailing edge 404 is provided with a first female mounting member 408 (see FIG. 9A). First notches 410 (see FIG. 9A) are provided at the ends of the first female mounting member 408. The roll tube male mounting member 310 engages in the first female mounting member 408 to attach the trailing edge 404 of the canopy 402 to the roll tube 302. The first projections 312 of the roll tube male mounting member 310 are received in the first notches 410 to locate the trailing edge 404 of the canopy 402 relative to the roll tube 302. Stated another way, the notches 410 assist in locating the canopy 402 along the lateral LA of the roll tube assembly 300.

The leading edge 406 of the canopy 402 is provided with a second female mounting member 412. Second notches 414 are provided at the ends of the second female mounting member 412 (see FIG. 11). The lead rail male mounting member 512 engages in the second female mounting member 412 to attach the leading edge 406 of the canopy 402 to the lead rail 502. Second projections 514 of lead rail mounting member 512 are received in the second notches 414 to locate the leading edge 406 of the canopy 402 relative to the lead rail 502. In this embodiment, the canopy 402 is removable from the awning 100 without disassembly of the awning. The canopy 402, having the first and second female mounting members 408, 412, can be removed by unclipping said female mounting members from the roll tube 302 and the lead rail male mounting members 310, 512, respectively. Allowing for easier canopy installation, removal, replacement, and/or repair.

Installation of the awning 100 onto a dwelling will now be described. In one example embodiment, the awning 100 is provided as a fully assembled unit with the exception of the anchor 204, which is initially freely positionable relative to remainder of the awning 100 and the dwelling. Installation begins by placing the anchor 204 against a wall or other surface of the dwelling or recreational vehicle on which the awning 100 is to be installed with the long portion 206 being substantially parallel to the mounting surface and the mounting hook 212 pointing away from the ground. This placement also results in the short portion 208 of the anchor 204 being substantially parallel to the ground and the latch 214 pointing away from the dwelling (see FIG. 4A). Fasteners are driven through the apertures 210 (see, for example, FIG. 5) provided on the long portion 206 and into the dwelling, thereby attaching the anchor 204 to the dwelling. Next, the awning 100 is positioned relative to the anchor 204 such that the roar face 222 of the housing 202 faces the dwelling (see, for example, FIG. 4A). The awning 100 is maneuvered relative to the anchor 204 to cause the mounting hook 212 to engage into the first slot 226. With the mounting hook 212 engaged in the first slot 226, the awning 100 is then rotated about the mounting hook 212 to cause the latch 214 to enter into the second slot 228 (see, for example, FIGS. 6A-6E). The latch 214 interfaces with the retainer 230 as the latch 214 enters the second slot 228. As the awning 100 is rotated, the interfacing between the latch 214 and the retainer 230 automatically causes the retainer 230 to move from resting position 230*a* to a locked condition 230*b* once the rear face 222 of the housing 202 is rotated to be substantially parallel with the long portion 206 of the anchor 204. Thus, the awning 100 is quickly and reliably secured to the dwelling. The awning 100 is enabled once the battery is in place (e.g., connected to the awning) or a power source is connected, and a position of the awning is not overly tilted (e.g. 5° longitudinally (LA) or 15° laterally (LAT)). Responsive to the awning 100 being overly tilted, the user will be instructed to reinstall or remount the awning 100, in one example embodiment, the awning 100 will remain in a disabled state after the power source is connected until the awning 100 is calibrated. The retainer 230 can be provided with a release mechanism that moves the retainer 230 to an unlocked condition 230*d* in order to allow for removal of the awning 100 from the dwelling. The awning 100 is located relative to the anchor 204 due to the dimensions of the first and second slot 226, 228, which each terminate prior to reaching the first end 216 and the second end 218 of the housing 202. Essentially, the first and second slots 226, 228 are each dimensioned to accept the mounting hook 212 and the latch 214, respectively, while limiting movement along the longitudinal axis LA of the mounting hook 212 and the latch 214 relative to the first and second slots 226, 228.

Figure 6A:
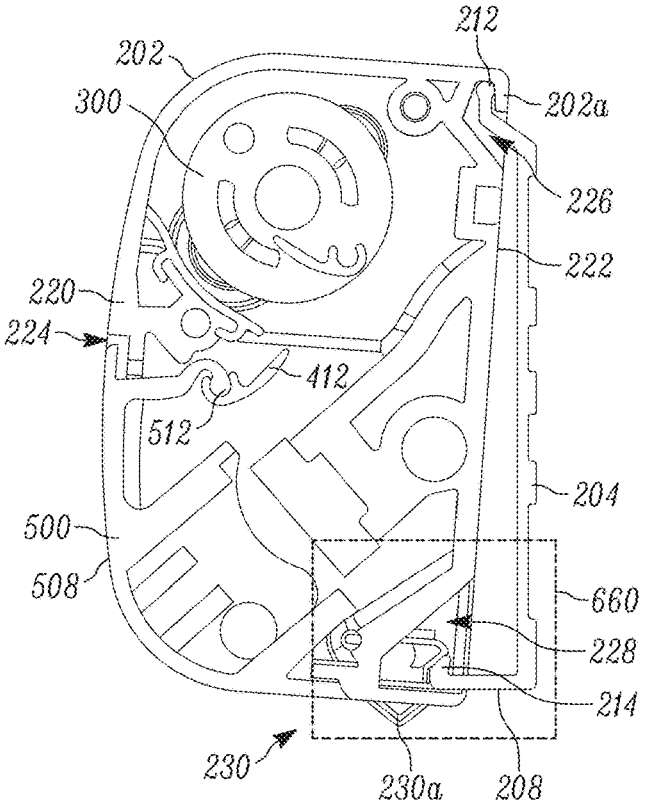
FIG. 6A is a sectional view of the awning taken along lines 6-6 of FIG. 5 showing an anchor in an unlatched position.
Figure 6B:
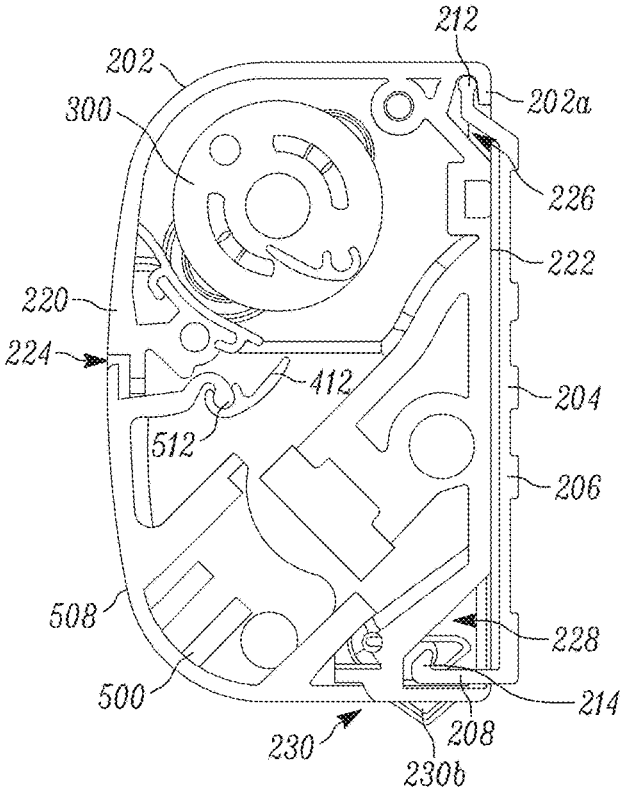
FIG. 6B is a section view of the awning taken along lines 6-6 of FIG. 5 showing an anchor in a latched position.
Figure 6C:
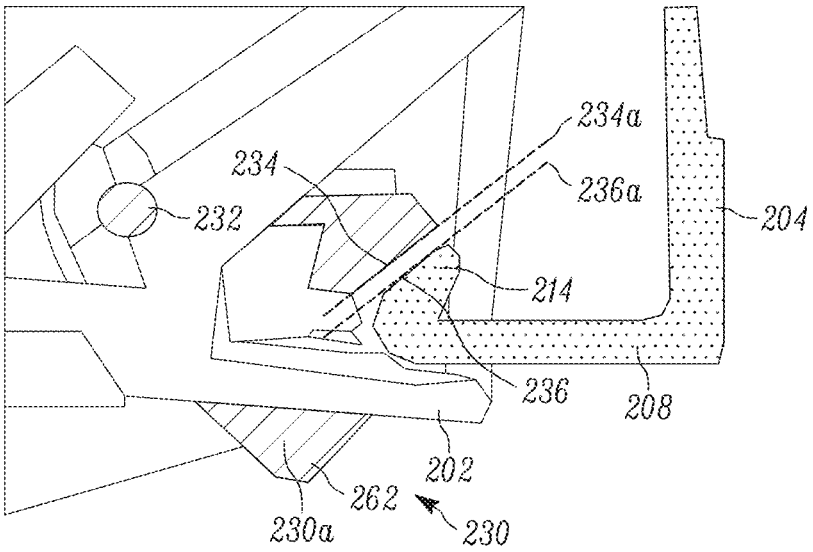
FIG. 6C is a zoomed in view of the area defined in the box 660 of FIG. 6A.
Figure 6D:
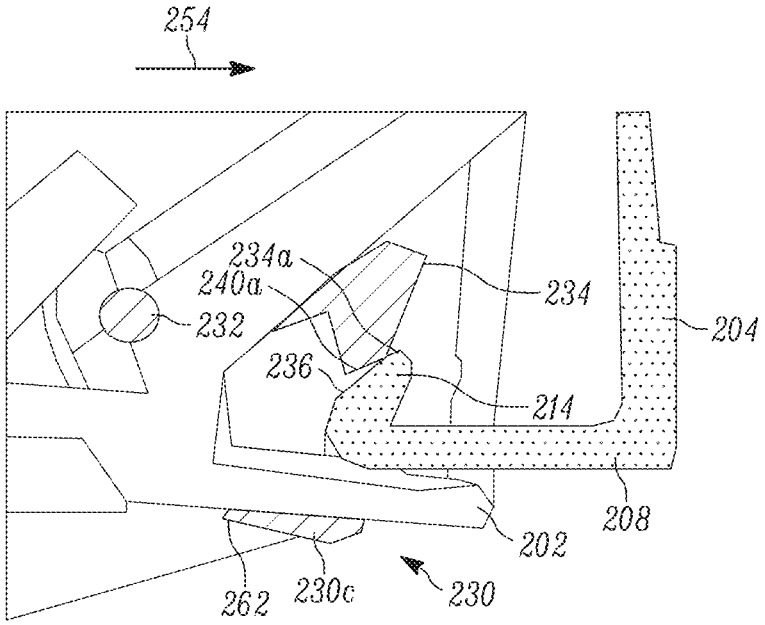
FIG. 6D is a magnified view of the area defined in the box 660 of FIG. 6A wherein a latch is being inserted into a spring loaded retainer.
Figure 6E:
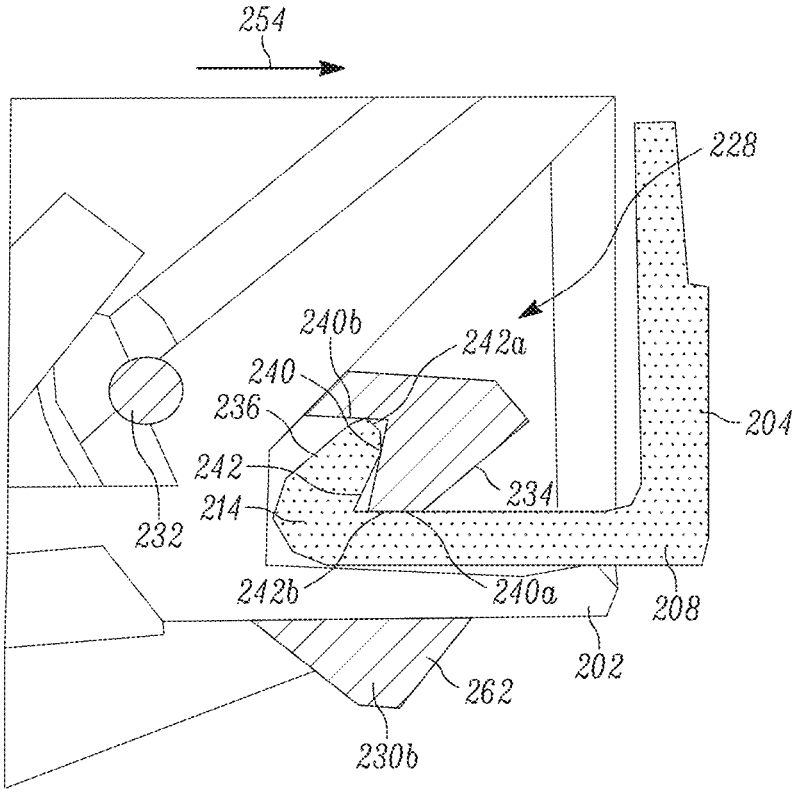
FIG. 6E is a magnified view of the area defined in the box 660 of FIG. 6A wherein a latch coupled to a spring loaded retainer.
Figure 6F:
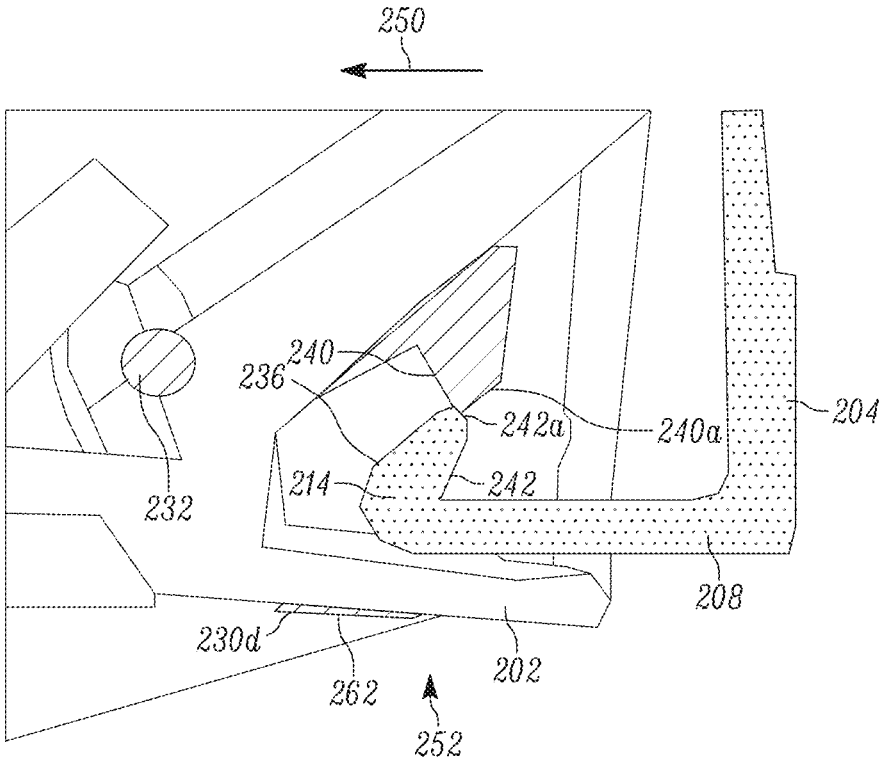
FIG. 6F is a magnified view of the area defined in the box 660 of FIG. 6A wherein a latch is being removed from a spring loaded retainer.
Figure 7A:
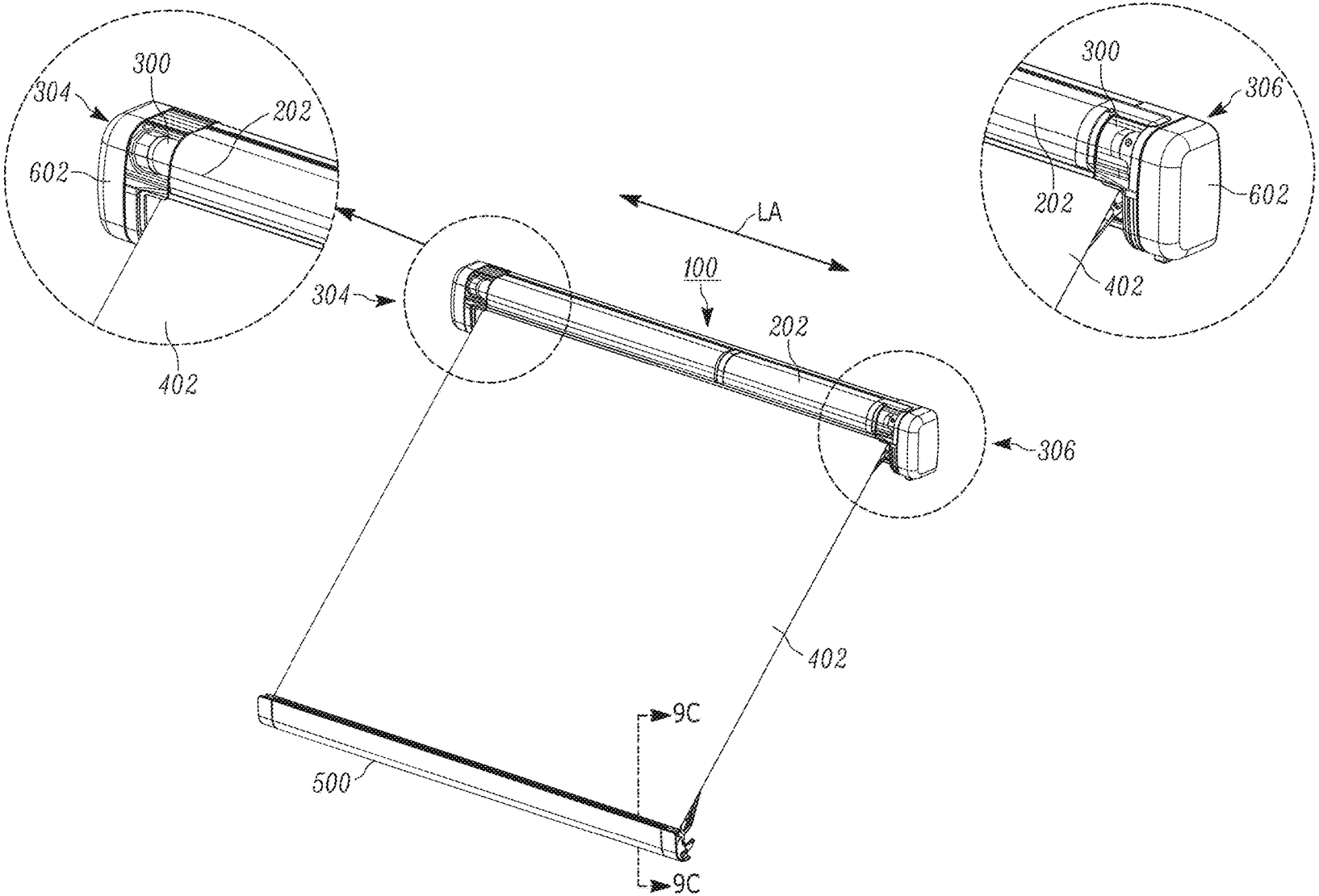
FIG. 7A illustrates perspective zoomed in views of part of the ease assembly in accordance with one example embodiment of the present disclosure.
Figure 7B:
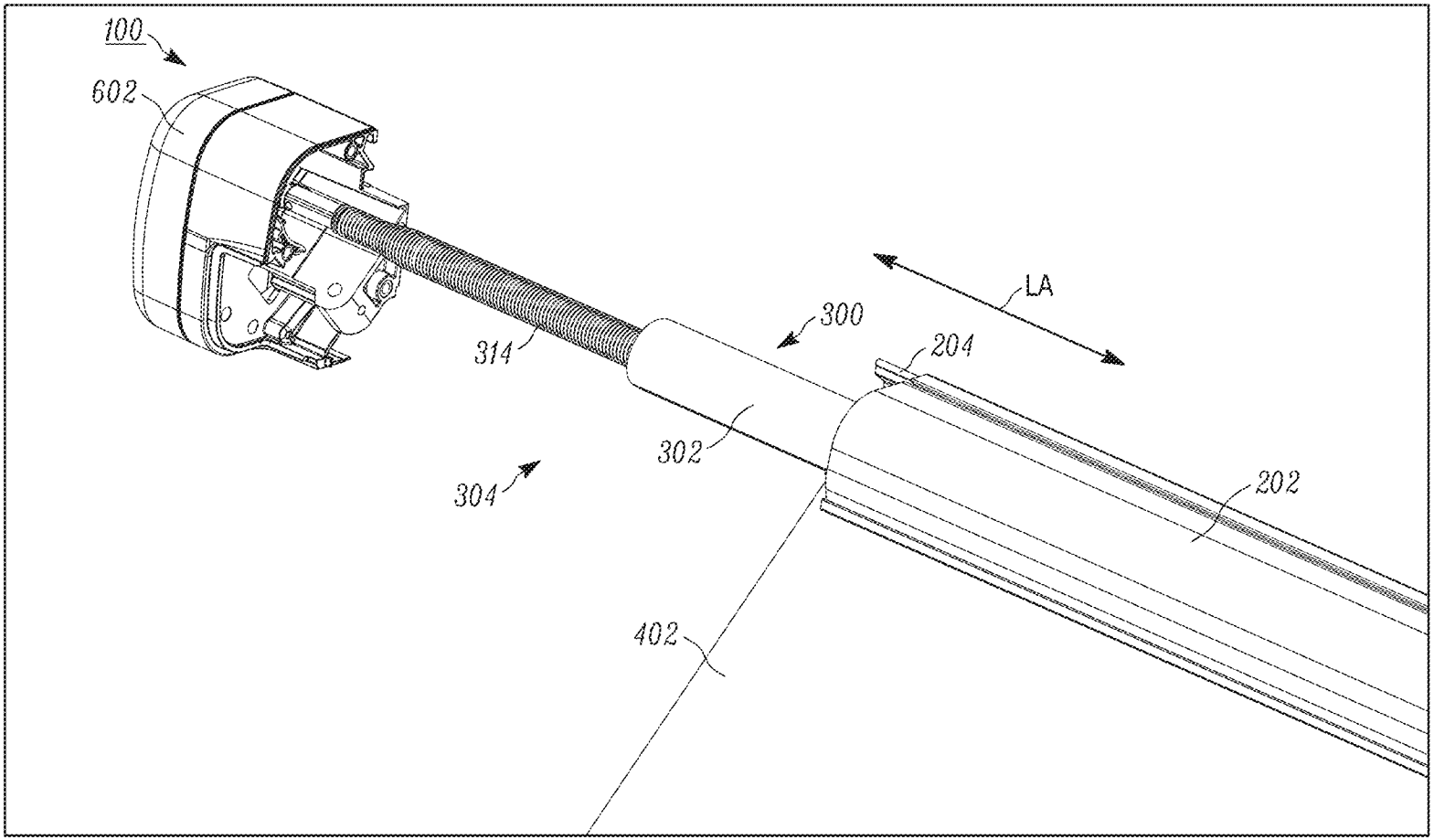
FIG. 7B is a perspective view of part of the awning of FIG. 2A showing details of a torsion spring.

The spring loaded retainer 230 secures the housing 202 to the anchor 204. The spring loaded retainer 230 rotates around a pivot point 232 (see FIGS. 6C and 6F) and has a user interaction point 262 that extends outside of the housing 202. As in the illustrated example embodiment of FIG. 6C-6F, the spring loaded retainer 230 comprises a spring front face 234 extending along a first axis 234*a* and the latch 214 comprise latch front face 236 extending along a second axis 216*a* when the latch and the spring loaded retainer are aligned for assembly. In one example embodiment, the first axis 234*a* and the second axis 236*a* are substantially parallel. As the housing 202 pivots about the mounting hook 212 and is pushed in a locking direction 254, the latch front face 236 and the spring, front face 234 interact, and the complementary nature of the first and second axis 234*a*, 236*a* causes the spring loaded retainer 230 to pivot from the resting position 230*a* to an opening position 230*c*. In the opening position 230*c*, a bottom spring surface 240*a* of the spring loaded retainer 230 is forced into contact with a top latch surface 242*a* of the latch 714. Wherein, the spring loaded retainer 230 pivots until the top latch surface 242*a* passes underneath the bottom spring surface 240*a*, at which point the spring loaded retainer, due to a pressure exerted to maintain the spring loaded retainer in the resting position 230*a*, pivots into a locking position 230*b*, as illustrated in FIG. 6F.

In one example embodiment, the locking position 230*b* comprises a latch inner surface 242 interacting with a spring inner surface 240. In another example embodiment, the latch inner surface 242 is positioned to extend along a latch inner axis set at an angle that is complementary to a spring inner axis on which the spring inner surface 240 extends, such that the latch 214 and the spring loaded retainer 230 are coupled together. In yet another example embodiment, the top latch surface 242*a* interacts with a spring extension surface 240*b* and the spring bottom surface 240*a* interacts with a latch extension surface 242*b*. For example, responsive to a force being exerted on the housing 202 in a removal direction 250, at least the latch inner surface 242 interacts with the spring inner surface 240 to prevent the housing from being removed from the anchor 204. In one example embodiment, the latch 214 and the spring loaded retainer 230 are configured to abut each other when the latch is inserted into the second slot 228 and the spring loaded retainer is pushed into the locking position 230*b*. Responsive to the user desiring to remove the housing 202 from the anchor 204, the user exerts a force onto the user interaction point 262 in a spring release direction 252. The force exerted by the user pivots the spring loaded retainer 230 away from the latch 214, such that the latch inner surface 242 no longer interacts with the spring, inner surface 240, and the housing 202 can be easily removed from the anchor 204, as illustrated in FIG. 6F. Once the latch 214 is free from the spring loaded retainer 230, the housing 202 can be rotated and then lifted off the mounting hook 212, and the housing is then disassembled from the anchor.

Operation of the awning 100 will now be described. The awning 100 has autonomous function at the time of installation and can operate without the user downloading an application, in one example embodiment, disabling the 100 shuts down said autonomous function, and enabling the awning from disablement does not require recalibration. In the retracted position, the canopy 402 is wound about the roll tube 302. The lead rail assembly 500 is received in the opening 224 provided on the housing 202 such that the front face 508 of the lead rail 502 is substantially flush with the front face 220 of the housing 202 (see, for example, FIGS. 6A-6B). In this position, the lead rail assembly 500 and the housing 202 cooperate to form an enclosure in which the folded spring arm assemblies 600 are received. The torsion spring 314 is arranged to apply a torque on the roll tube 302 in the winding direction such that tension is produced in the canopy 402 (see, for example, FIG. 7B). Further, responsive to the extension of the canopy 402, the torque applied to the roll tube 302 by the torsion spring 314 is progressively increased by the "winding" caused by the roll tube revolutions during the unwinding on the canopy. The tension in the canopy 402 biases the lead rail 502 toward the rear face 222 of the housing 202, essentially helping to maintain the awning 100 in the retracted position, as illustrated in FIG. 4A. As noted above, the gas springs 618 are arranged to bias the awning 100 toward the extended position, as illustrated in FIG. 2A. However the torsion spring 314 and the gas springs 618 are selected such that force applied by the gas springs 618 to the roll tube 302 is greater than the torque applied by the torsion spring 314. Stated another way, the force applied by the gas spring 618 cannot be overcome by the torsion spring 314 alone when the spring arm assembles 600 are extended. Stated yet another way, absent an additional force, the spring arm assemblies 600 will remain extended.

When it is desired to move the awning 100 into the retracted position, power is provided to the motor 320 to rotate the motor in the winding direction. The rotation of the motor 320 is transferred to the roll tube 302 via the one-way drive mechanism 318, the force of the motor 320, along with the force of the torsion spring 314, overcomes the force of the gas springs 618 (e.g., the force applied via the spring arm assemblies 600 to the lead rail assembly), and the canopy 402 is wound onto the roll tube 302. As canopy 402 winds onto the roll tube 302, the spring arm assemblies 600 begin to collapse and the lead rail assembly 500 begins to move back toward the dwelling. The motor 320 continues to rotate in the winding direction until the canopy 402 is fully wound onto the roll tube 302, at which point the spring arm assemblies 600 are fully folded and the lead rail assembly 500 is received in the opening 224 of the housing 202. In one example embodiment, the combined forces of the motor 320, the gas spring 618, and the torsion spring 314 are such that absent the motor rotating the winding direction, the canopy 402 will remain at the extension the canopy was at when the force provided by the motor ceased. The motor 320 will prevent the gas spring 618 from re-extending the arm assemblies 600 and thus the canopy 402, by preventing the roll tube 302 from rotating in the unwinding direction. Additionally, the force generated by gas springs 618 will prevent the torque applied by the torsion spring 314 from fully retracting the canopy 320.

When it is desired to move the awning 100 to the extended position, the motor 320 is actuated to allow the gas springs 618 to extend the canopy 402 (see, for example, FIG. 8A), thereby causing the motor to act as a break (e.g., slowing the extension of the awning 100) during the extension of the canopy 402. The breaking function of the motor 320 is transferred from the motor 320 to the roll tube 302 via the one-way drive mechanism 318. The one-way drive mechanism 318 applies the break force that prevents the gas springs 618 from extending the arm assemblies 600, and thus the canopy 402, abruptly, or too quickly for safety. As the roll tube 302 rotates in the unwinding direction, the canopy 402 is permitted to unroll from the roll tube 302 and the torsion spring 314 is "wound" generating additional torque in the winding direction with each rotation of the roll tube. Due to the biasing nature of the gas springs 618, the spring arm assemblies 600 unfold out of the housing 202 to move the lead rail assembly 500 out relative to the housing 202 and away from the dwelling. The force provided by the torsion spring 314 and the arrangement of the spring arm assemblies 600 keeps the canopy 402 taut as the awning 100 moves to the extended position. The motor 320 continues to govern the unwinding of the canopy 402 until the awning 100 is moved to the fully extended position, at which point the canopy 402 is substantially unwound from the roll tube 302 such that shade and shelter is provided. In one example embodiment, the forces applied to the roll tube 302 by the torsion spring 314, the gas spring 618, and the motor 320 result in an awning 100 that can be moved by the application of a small force to the lead rail assembly 500. In this example embodiment, the small force is a force below a force threshold, wherein the force threshold is between 20 N to 75 N. Stated another way, a differential between the force applied by the gas spring 618 in the unwinding direction and the force applied by the torsion spring 314 is substantially equal to the force threshold.

As shown in the illustrated example embodiments of FIGS. 8A-8G, the one-way drive mechanism 318 comprises an outer hub 318*a*, one or more dowel pins 118*b*, an inner hub 318*c*, and a retaining ring 318*d*. Wherein, the dowel pins 318*b* interact with the inner and outer hubs 318*c*, 318*a* respectively, and the retaining ring 318*d* couples the inner hub 318*c* to the outer hub 318*a*. In one example embodiment, such as when a locked functionality of the one-way drive mechanism 318 is activated, the inner hub 318*c* is held stationary by the motor 320, which through the interaction of the dowel pins 318*b* and the outer hub 318*a*, prevents the outer hub and thus the roll tube 302 from rotating in a first direction 319*a* (e.g., clockwise or the unwinding direction). In another example embodiment, such as when a freewheel functionality of the one-way drive mechanism 318 is activated, the inner hub 318*c* is held stationary, while the outer hub 318*a*, and thus the roll tube 302 rotates in a second direction 319*b* (e.g., counter-clockwise, or in the winding direction).

Figure 8H:
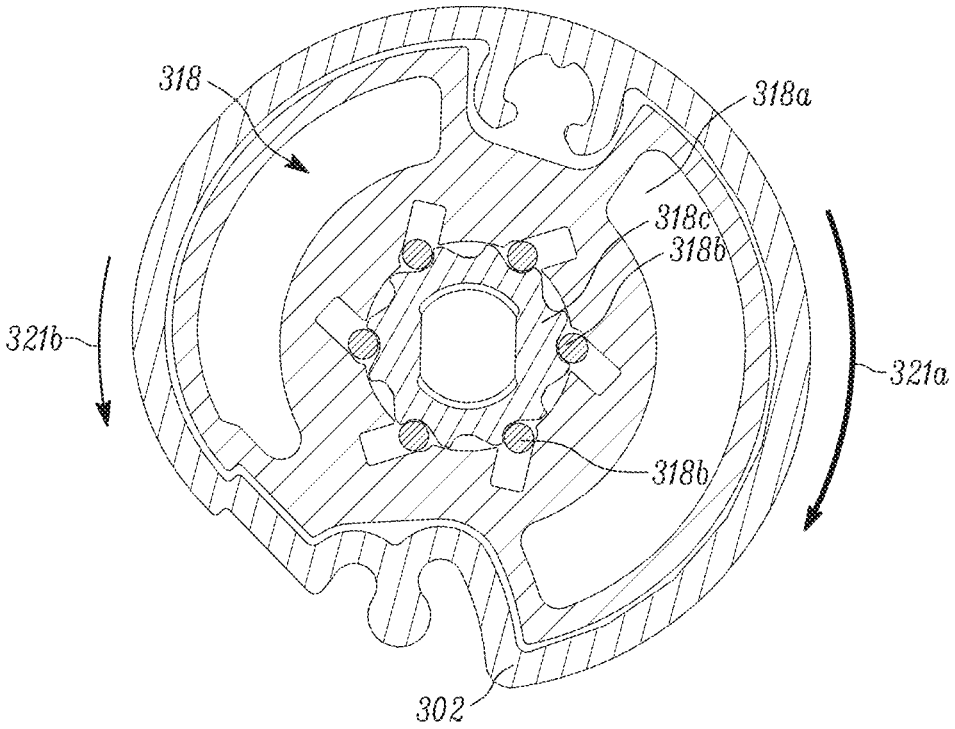
FIG. 8H is a cross-section taken along lines 8F-8F of FIG. 8B of a one-way drive mechanism when an awning is closed.

In the example embodiment illustrated in FIG. 8H, responsive to the awning 100 being closed, the one-way drive mechanism 318 prevents the torque produced by the gas spring 618 of the spring arms 600 to overcome the torque produced by the torsion spring 314. In the illustrated example embodiment, the gas springs 618 apply a force in a first torque direction 321*a* (e.g., clockwise) and the torsion spring 314 applies a force in a second torque direction 321*b* (e.g., counter-clockwise). In this example embodiment, the inner hub 318*c* is coupled to the motor 320, and is thus dependent upon the motion of the motor, while the outer hub 318*a* is coupled to the roll tube 302 and is thus dependent upon the motion of the roll tube. Further, when the awning 100 is closed, the motor 320 holds the inner hub 318*c* stationary, while the torque generated by the gas spring 618 is transferred to the outer hub 318*a*. The outer hub 318*a* interacts with the dowel pins 318*b*, which consequently pushes the dowel pins against the inner hub 318*c*, preventing rotation of the outer hub.

Figure 8I:
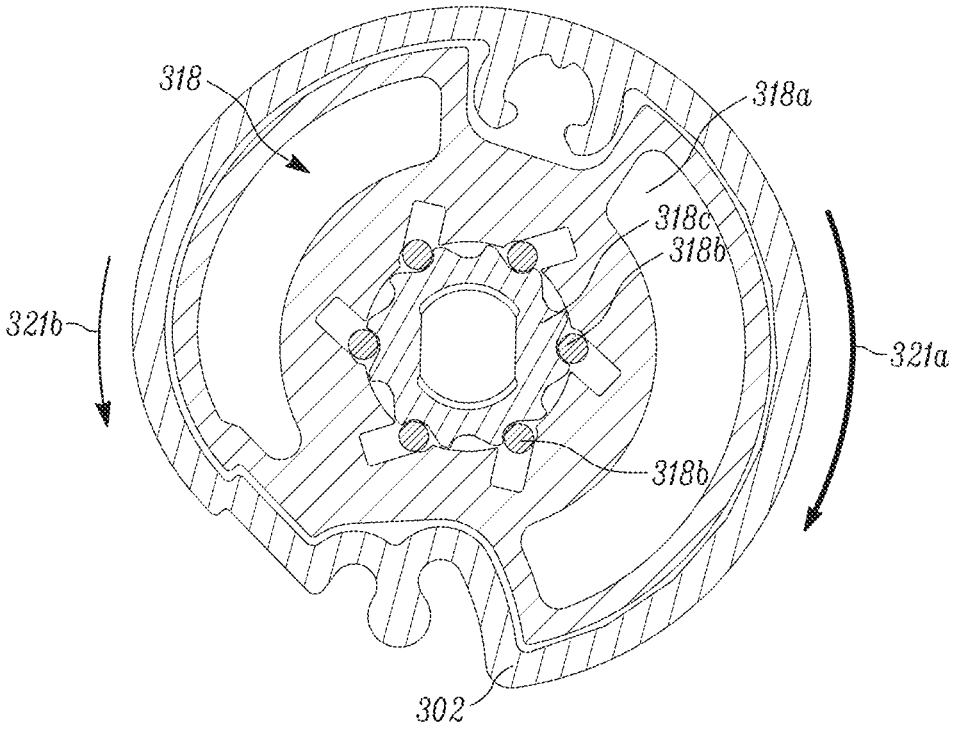
FIG. 8I is a cross-section taken along lines 8F-8F of FIG. 8B of a one-way drive mechanism when an awning is being opened.

In the example embodiment illustrated in FIG. 8I, responsive to the awning 100 opening, the motor 320 rotates the inner hub 318*c* in the same direction (e.g., in the first torque direction 321*a*) as the torque produced by the gas spring 618. The torque from the gas spring 618 is applied to the outer hub 318*a*, which applies the gas spring torque to the inner hub 318*c*, via the dowel pins 318*b*. In this example embodiment, the motor 320, through the one-way drive mechanism 318 acts as a break on the gas springs 618, and thus controls the awning 100 unfurling speed.

Figure 8J:
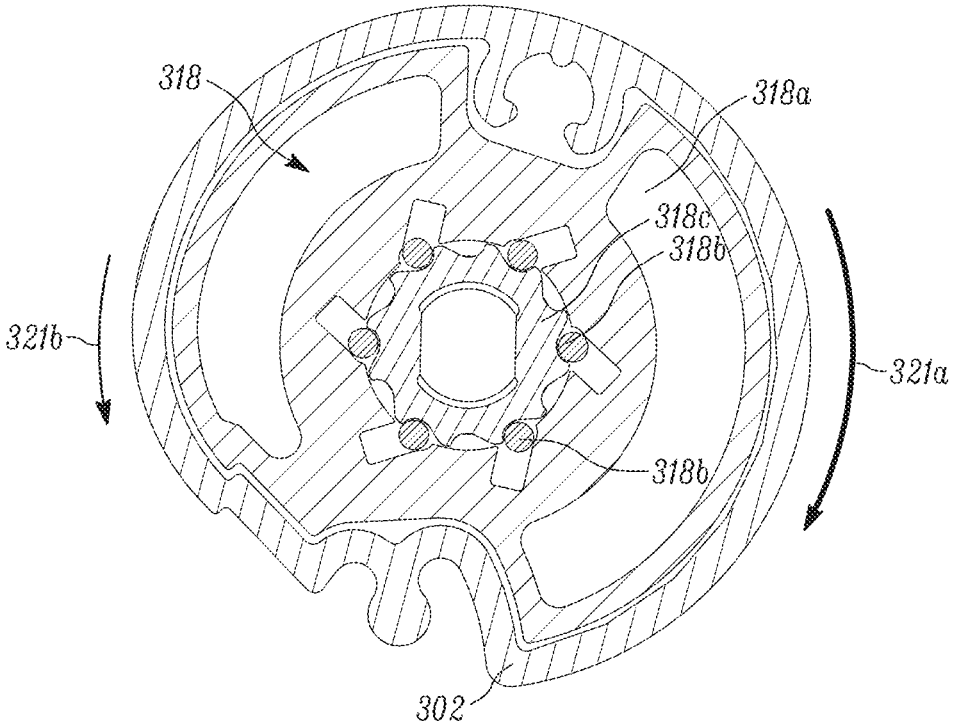
FIG. 8J is a cross-section taken along lines 8F-8F of FIG. 8B of a one-way drive mechanism when an awning is being closed.

In the example embodiment illustrated in FIG. 8J, responsive to the awning 100 closing from the extended position, the motor 320 rotates the inner hub 318*c* in the same direction (e.g., in the second torque direction 321*b*) as the torque produced by the torsion spring 314. The motor 320 applies torque to the inner hub 318*c*, which is applied to the outer hub 318*a*, via the dowel pins 318*b*. In this example embodiment, the motor 320, through the one-way drive mechanism 318 applies sufficient torque, in conjunction with the torsion spring 314, to overcome the torque generated by the gas springs 618 on the outer hub, causing the awning 100 to close.

Figure 8K:
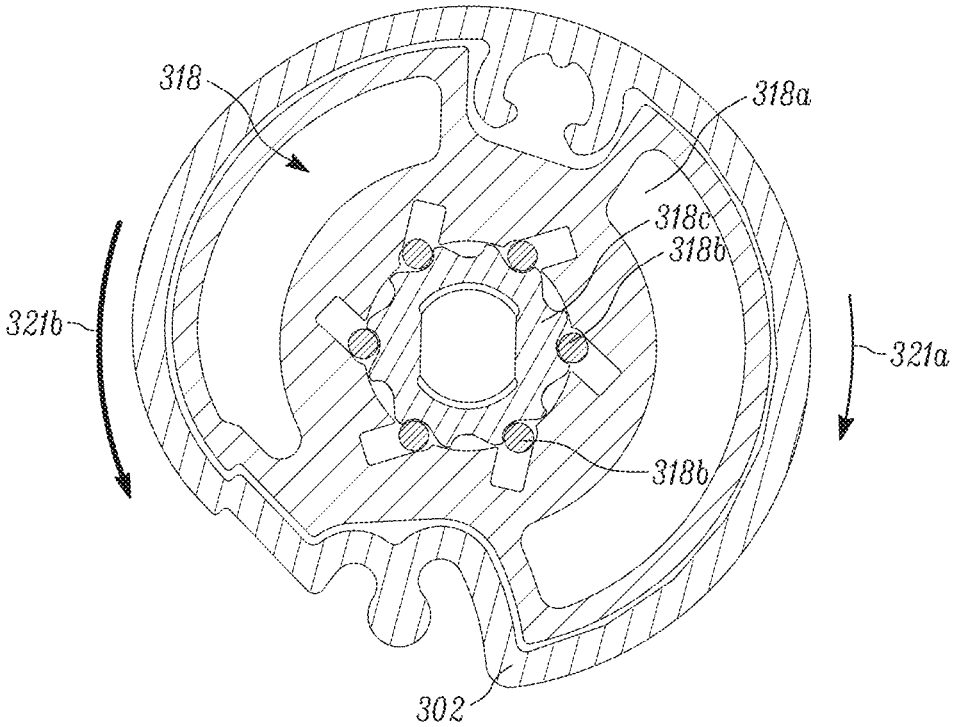
FIG. 8K is a cross-section taken along lines 8F-8F of FIG. 8B of a one-way drive mechanism when an awning is being closed manually.

In the example embodiment illustrated in FIG. 8K, responsive to the awning 100 being closed manually from the extended position, the motor 320 prevents rotation of the inner hub 318*c* in the same direction (e.g., in the first torque direction 321*a*) as the torque produced by the gas springs 618 via interaction of the dowel pins 318*b* with the outer hub 318*a*. The torque generated by the torsion spring 314 is applied to the outer hub 318*c*, via the dowel pins 318*b*. The dowel pins 318*b* do not act upon the inner hub 318*c* when the outer hub 318*a* is rotating in the second torque direction 321*b*, thus, the outer hub 318*c* is free to rotate in the in the second torque direction 321*b*, responsive to a three being applied to the awning 100 that is sufficient to overcome the gas springs 618.

As illustrated in the example embodiment of FIG. 8A, the one-way drive mechanism 318 has three status dependent modes of operation. For torque that is applied by the torsion spring 314 to the roll tube 302 in the winding direction, the one-way drive mechanism 318 actuates the connection between the roll tube 302 and the motor 320 to apply the threshold force to overcome the opposing force generated by the gas spring 618. For torque that is applied by the gas springs 618 via the canopy 402 to the roll tube 302 in the unwinding direction, the one drive mechanism 318 maintains the coupling between the roll tube 302 and the motor 320, thereby allowing the motor 320 to act as a brake and preventing uncontrolled unfurling of the awning 100. For torque that is applied by the motor 320 to the roll tube 302 in the winding direction, the one-way drive mechanism 318 maintains the coupling between the roll tube 302 and the motor 320, thereby allowing the motor to retract the awning 100.

Figure 12:
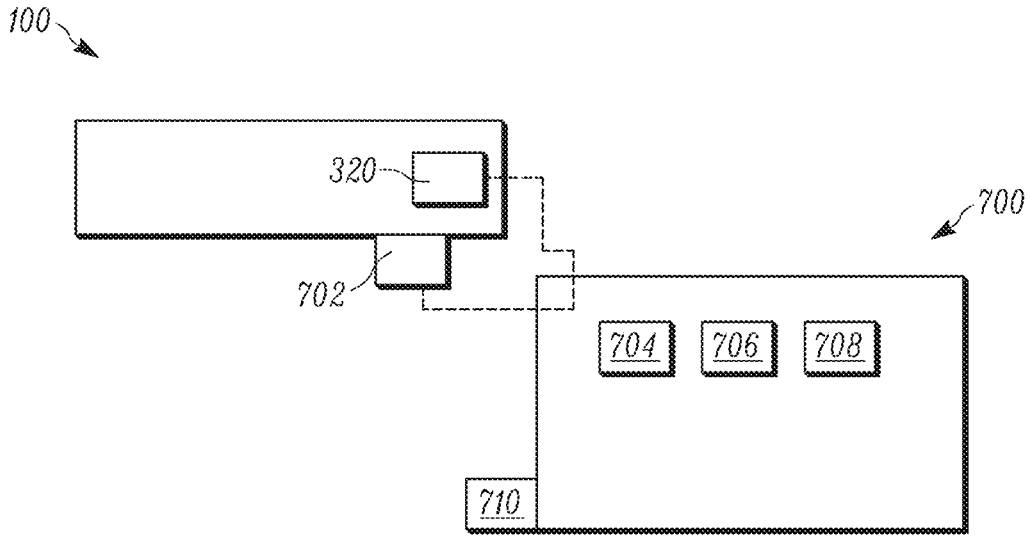
FIG. 12 is a schematic of a status monitoring system for use with the awning of FIG. 2A.
Figure 13:
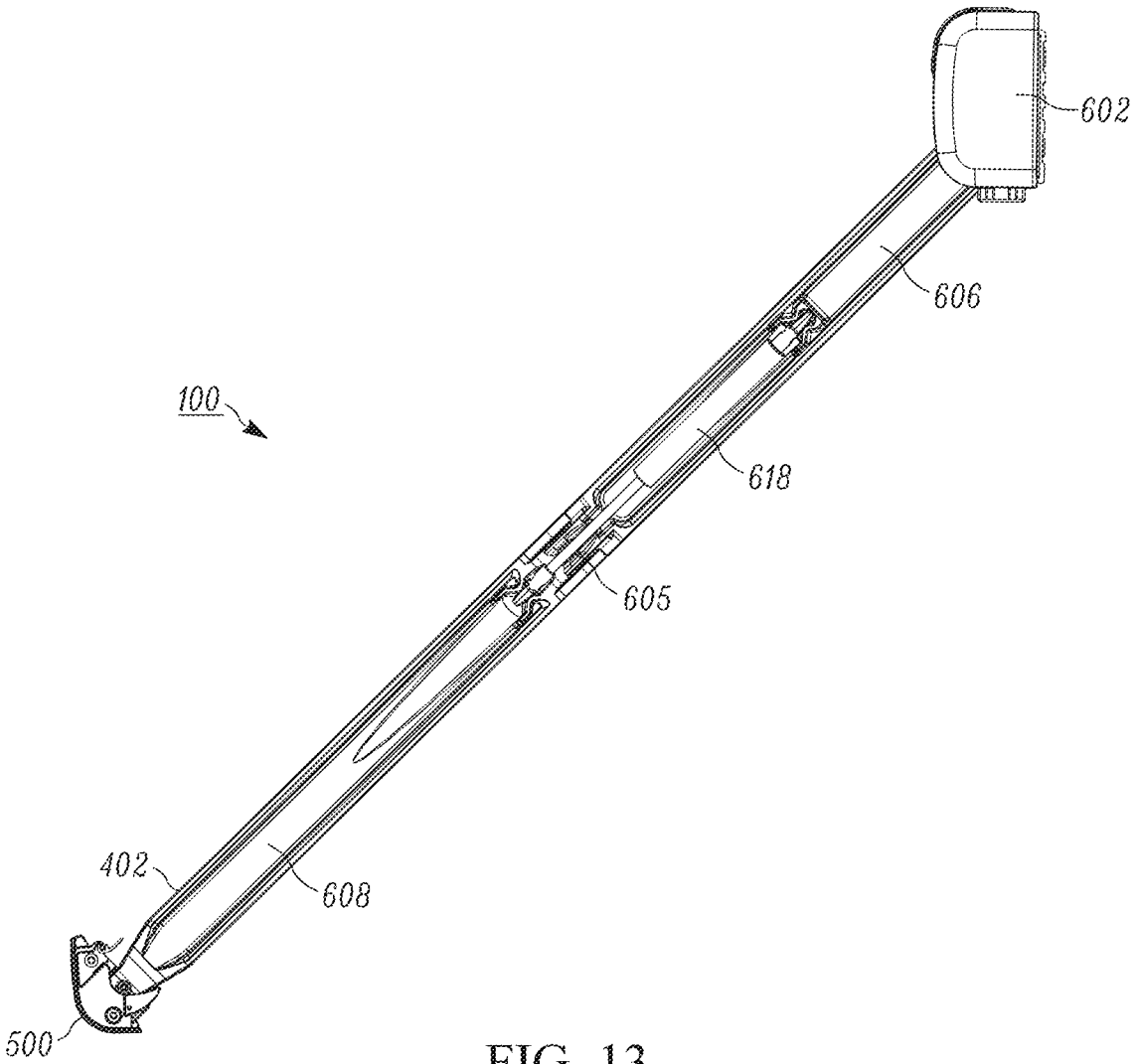
FIG. 13 is a left side view of a fully extended awning assembly in accordance with one example embodiment of the present disclosure.

Referring to FIG. 12, the awning 100 can be provided with a status monitoring system 700 that monitors awning conditions and environmental conditions to enhance the robustness of the awning 100. The status monitoring system 700 comprises at least one of memory (e.g., random access memory, read only memory, etc.), a motherboard, a transceiver, a processor, or the like. In one example embodiment, the user supplements the status monitoring system 700 by downloading an application. The awning 100 will communicate with the application once the battery is locked into place or the awning is attached to the power source. In one example embodiment, the awning 100, post calibration, will be in an unlocked/pairing mode for a connection timeframe (e.g., 12 hrs, from a time point of the calibration) and will auto-lock after the connection timeframe has passed. In this example embodiment, during the connection period, any user can connect to the awning 100, and after the connection period ends the awning is locked and will not connect to any new users. In one example embodiment, during the connection period, a connected user can instigate locking of the awning 100 prior to the expiration of the connection period, and generate a PIN (e.g., a last four digits of a serial number associated with the awning). Additional users may enter the PIN to connect to the awning 100 during the locking period. The user, having connected to the awning 100, can cause the awning to reenter the unlocked mode, so that additional users may connect to the awning. In one example embodiment, the application comprises a "My Awnings" area, where connected awnings are represented. In another example embodiment, the awning 100 will recalibrate after being manually disabled.

The application can be used to enable or disable the awning 100 (e g., rather than manually). In this embodiment the application includes at least one of the following added features: a current awning status (e.g., a current temperature, a charge of a battery, current weather conditions, a position of the awning, and/or a tilt, a range, or a low-battery warnings), a three required to at least one of extend, stop, and retract the awning, performing, a force calibration, updating firmware, an option to lock or unlock the awning, scheduling awning extensions and/or retractions, an option to reset the awning to Factory default, a service mode option (e.g., to disable the awning). Service extend/retract, adjusting one of a wind, a sun and/or a temperature sensitivity level, adjusting a maximum extension of the awning, and adjusting one of a wind extension parameter, a sun retraction parameter and/or a sun extension delay parameter. In another example embodiment, responsive to the user selecting service mode when the awning 100 is extended, the application will alert the user that the awning is extended, and present the user with an option to cancel and retract awning prior to entering service mode. In this embodiment, service mode does not instigate a calibration absent a loss of connection to the power source. In yet another example embodiment, the user views an application setting screen of the application, but the user cannot make adjustments.

In one example embodiment, the status monitoring system 700 is integrated into the awning 100, such as in the end cap 602. In another example embodiment, the status monitoring system 700 comprises an element separate from the awning 100 that communicates via short range signals with transceiver enabled components in communication with the motor 320. In one example embodiment, the status monitoring system 700 is in communication with the motor 320. In another example embodiment, the status monitoring system 700 includes a three axis accelerometer 702 that is mounted on one of the spring arm assemblies 600 (see FIG. 3). The accelerometer 702 can be configured to measure the angular position (e.g., along an x-axis, a y-axis and a z-axis) of the spring arm assemblies 600 during operation of the awning 100. In one example embodiment, the awning 100, using the accelerometer 702, is calibrated at its installation location. Stated another way, the awning 100 is calibrated at its actual position, and will account the obstructions (e.g., the awning will limit its maximum extension so as to not hit the obstruction), angle of extension (e.g., the area under the canopy 402 that is actually shaded), and other variables. By measuring the angular position of the spring arm assemblies 600 during extension and retraction of the awning 100, an operation profile is created that is based on the actual performance of the awning. Further, the operation profile detects an installation angle, which allows for self-calibration of the awning 100, responsive to multiple variables (e.g., an angle of attachment, an area shaded compared to an amount of extension of the awning, a position of the lead rail 500 relative to the housing 202, etc.). The accelerometer 702 can be programmed with information pertaining to the position of the spring arm assemblies 600 and the lead rail 500 when the awning 100 is in the fully retracted, fully extended positions, and partially retracted/extended positions. In one example embodiment, the information is used to negate or limit a need for limit switches (e.g., to prevent over extension) or an encoder, when identifying an intermediate extension position or limits of the full extension or retraction. Further, the information is used to determine an absolute location of the lead rail 500 at a plurality of locations between the extended and retracted positions, rather than relying on operation time and/or motor speed, which are linked to power supply. For example, absent the information, the absolute location, as opposed to a relative location, is not known, and the relative location can become progressively more inaccurate as time passes.

The accelerometer 702 can further be programmed to acknowledge kinesthetic communication to initiate an installation and/or removal mode, an example operation of which is discussed below. The status monitoring system 700 can further include the light sensor 704, a temperature sensor 706, a wind speed sensor 708, and any other sensor that monitors conditions of the environment. In one example embodiment, the accelerometer 702 functions as the motion sensor to detect movement of the awning 100 due to the effects of wind. Additionally, the status monitoring system can include short range wireless interconnection (e.g., Bluetooth) and/or Wi-Fi connectivity 710 to allow a user to control the awning 100 wirelessly. The Bluetooth and Wi-Fi connectivity 730 can also be used to pair the awning 100 with a home automation system and/or an application on a mobile device (e.g., a smart phone or computer). In one example embodiment, the status monitoring system 700 will remember prior users' mobile devices, and will reconnect, even after the mobile device has left the range of the connectivity. Advantageously, Bluetooth connectivity is low energy, and thus imposes minimal drain on the battery or power source. Additionally, while multiple users can control the same awning 100, merely a single user may be connected to the status monitoring system 700 at a time. Responsive to the user of the application selecting an extend or a retract option, the awning 100 will extend or retract, respectively, into the extended or retracted position, absent conditions that would hinder or obstruct extension or retraction. Responsive to the awning 100 being inhibited from extending or retracting, the awning 100 will be disabled and the application will display that the awning is disabled with a notification on the service screen "Extend/retract not completed. Check for obstruction." In one example embodiment, the application includes a "stop" button, that when actuated stops the awning 100 mid-extension or retraction.

The mobile device and/or home automation system communicates with the status monitoring system 700, wherein the user can set configuring parameters for the awning 100. The configuring parameters include identifying ideal temperatures, light intensities, etc. In one example embodiment, the user may identify a threshold amount of light and/or a threshold temperature in an area under the canopy 402 or through a window over which the awning resides (e.g., as detected by the light sensor 704). In another example embodiment, a preset threshold temperature or battery temperature range will be programmed into the awning 100, and when the temperature or battery temperature leaves the threshold range, the awning will be disabled. The awning 100 is enabled once the battery temperature and/or the temperature returns to a temperature within the temperature range. When the light sensor detects a light intensity over a set threshold, the awning 100 will extend to provide shade, or conversely, responsive to the light sensor detecting a light intensity below the set threshold, retracting the awning. In one example embodiment, responsive to the light intensity remaining below the set threshold for a light duration (e.g., 10 minutes) the awning will retract. Conversely, responsive to the light intensity remaining above the set threshold for the light duration (e.g., 10 minutes) the awning will extend. When the temperature sensor 706 detects a temperature over a temperature threshold, the awning 100 will extend to provide shade, or conversely, responsive to the temperature sensor detecting a temperature below the temperature threshold, retracting the awning, in one example embodiment, the awning 100 extends (e.g., upon manual or application instruction, during calibration, etc.) unless said temperature is outside acceptable range, high wind or air motion is detected during extension, the battery does not have enough power, and/or something is in the way of the awning extending, in another example embodiment, responsive to the battery being in a low-powered state, the awning 100 retracts and enters a sleep mode to conserve energy.

In one example embodiment, the mobile device and/or home automation system allows a user to check a status of the awning 100, such as a current power level, an awning extension or retraction amount, a temperature, light intensity near or under the awning, etc. Further, the mobile device and/or home automation system can be used by the user to troubleshoot during installation, removal, and use. In one example embodiment, the awning 100 will be configured to extend on its own at dawn, or in sunny conditions, and retract at dusk, as determined by a weather source in communication with status monitoring system 700, the light sensor 704, and/or the temperature sensor 706. In another example embodiment, the awning 100 retracts in colder conditions, as determined by the weather source or temperature sensor 706, when transfer of heat through a window, or to an area under the awning is desirable. In another example embodiment, the wind speed sensor 708 is constantly monitoring the wind speed while the awning 100 is extended, and responsive to a wind speed over a wind speed threshold being detected, the awning will retract. The wind speed threshold can be altered to account for motion of the dwelling. In yet another example embodiment, the user, using the application, will be presented with an icon indicating that the awning 100 has been disabled, and the reason that the awning has been disabled, such as manually, due to at least one of wind, snow, temperature, and/or battery power levels, or that the awning has been disable via the application (e.g., such as by the user selecting service mode). In another example embodiment, the awning 100 can be disabled due to a physical blockage preventing the awning from extending or retracting. The awning 100 will stop once a motor stall threshold is reached (e.g., between about 15N-1000N). In one example embodiment, the motor stall threshold is greater than the force threshold.

In one example embodiment, the status monitoring system 700 is connected via WIFI, or short range wireless signals (e.g., Bluetooth) to a remote sensing device. The remote sensing device can be placed at a first location inside the dwelling to provide a configurable light intensity at the first location, for example, on a desk or table. In one example embodiment, the awning 100 extends or retracts merely to maintain a light intensity, or a light intensity over or under a light threshold, at the first location. In this example, the awning 100 retracts or extends merely to the extent required to provide the desired parameters at the first location. Further, as the sun or other light source, moves relative to the remote sensing device, the awning 100 will adjust to maintain the desired parameters at the first location. In one example embodiment, the user sets parameters as to maximum extension, to determine the amount the awning 100 will extend. In another example embodiment, the user sets disable dates, which will disable programmed actions of the awning 100 during the disable dates. For example, the user may be travelling during the month of March, and will disable the awning 100 from March 1st to March 31st.

Figure 14:
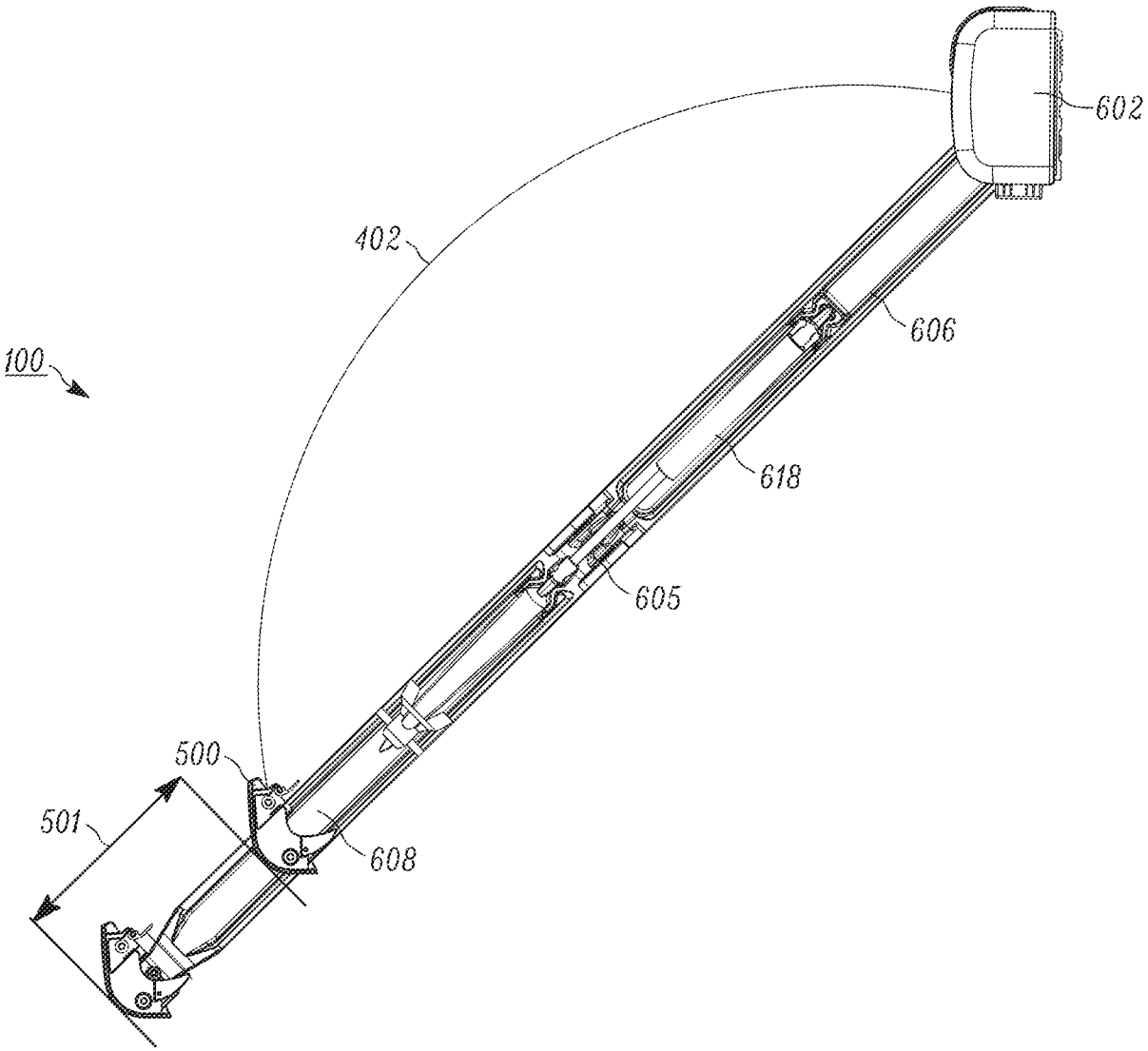
FIG. 14 is a left side view of the awning assembly of FIG. 13 wherein a canopy is billowed.

One example operating profile of the status monitoring system 700 will now be explained. Specifically, as illustrated in the example embodiments of FIGS. 13-16, operation of the awning 100 on a windy day. In the event that the status monitoring system 700 senses excessively windy conditions, the status monitoring system 700 communicates with the motor 320 to begin rolling up the canopy 402 to move the awning 100 to the retracted position in order to prevent damage from occurring to the awning 100. During this operation, an excessive wind gust may result in a "billow event" as illustrated in FIG. 14, which can cause the spring arm assemblies 600 to partially collapse, for example shorten by a collapse distance 501. In one example embodiment, the gust will be detected by the wind speed sensor 708 of the awning 100, and the awning will retract before the canopy 402 is caused to billow.

Figure 15:
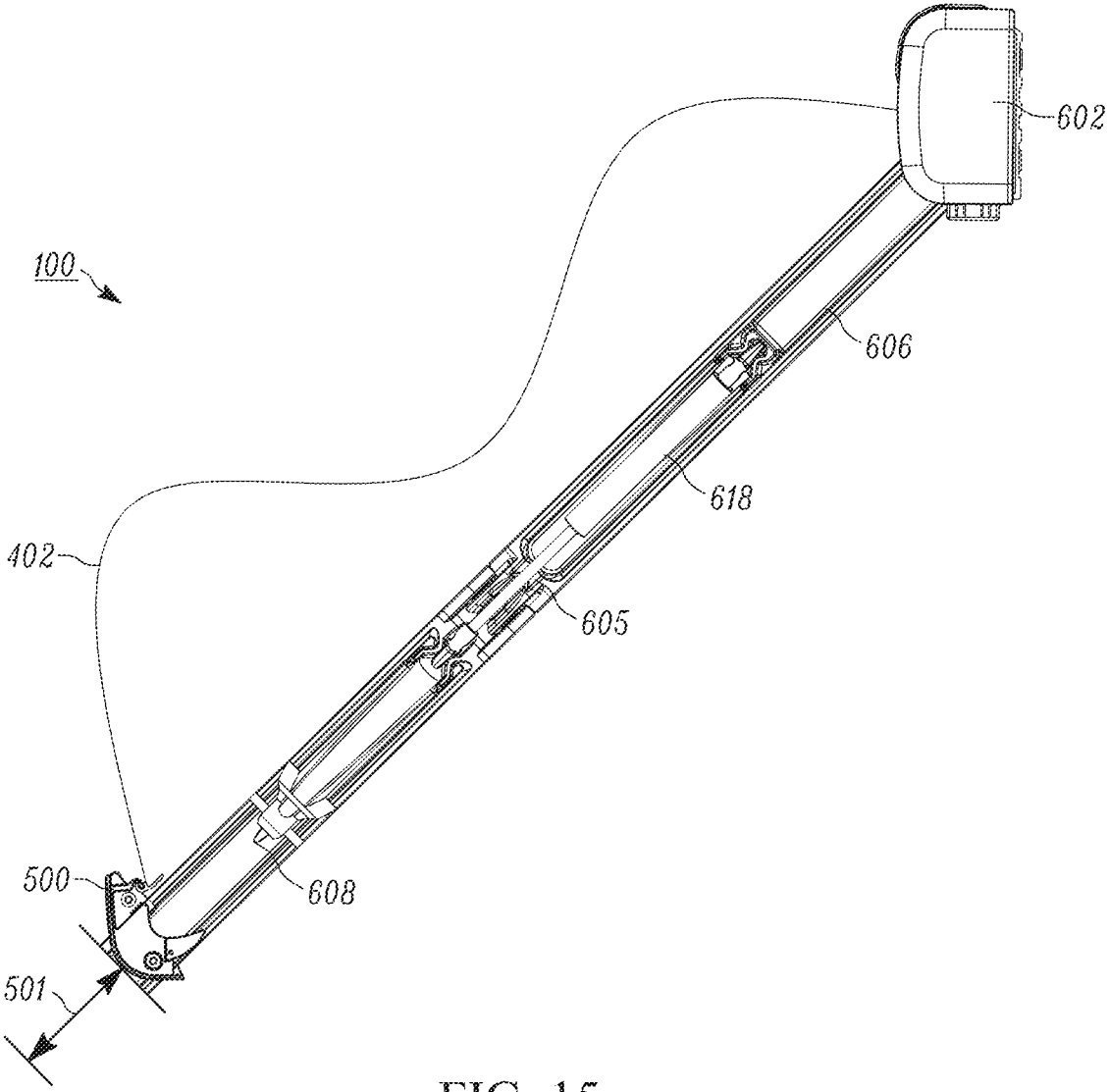
FIG. 15 is a left side view of the awning assembly of FIG. 13 wherein a canopy is partially billowed.
Figure 16:
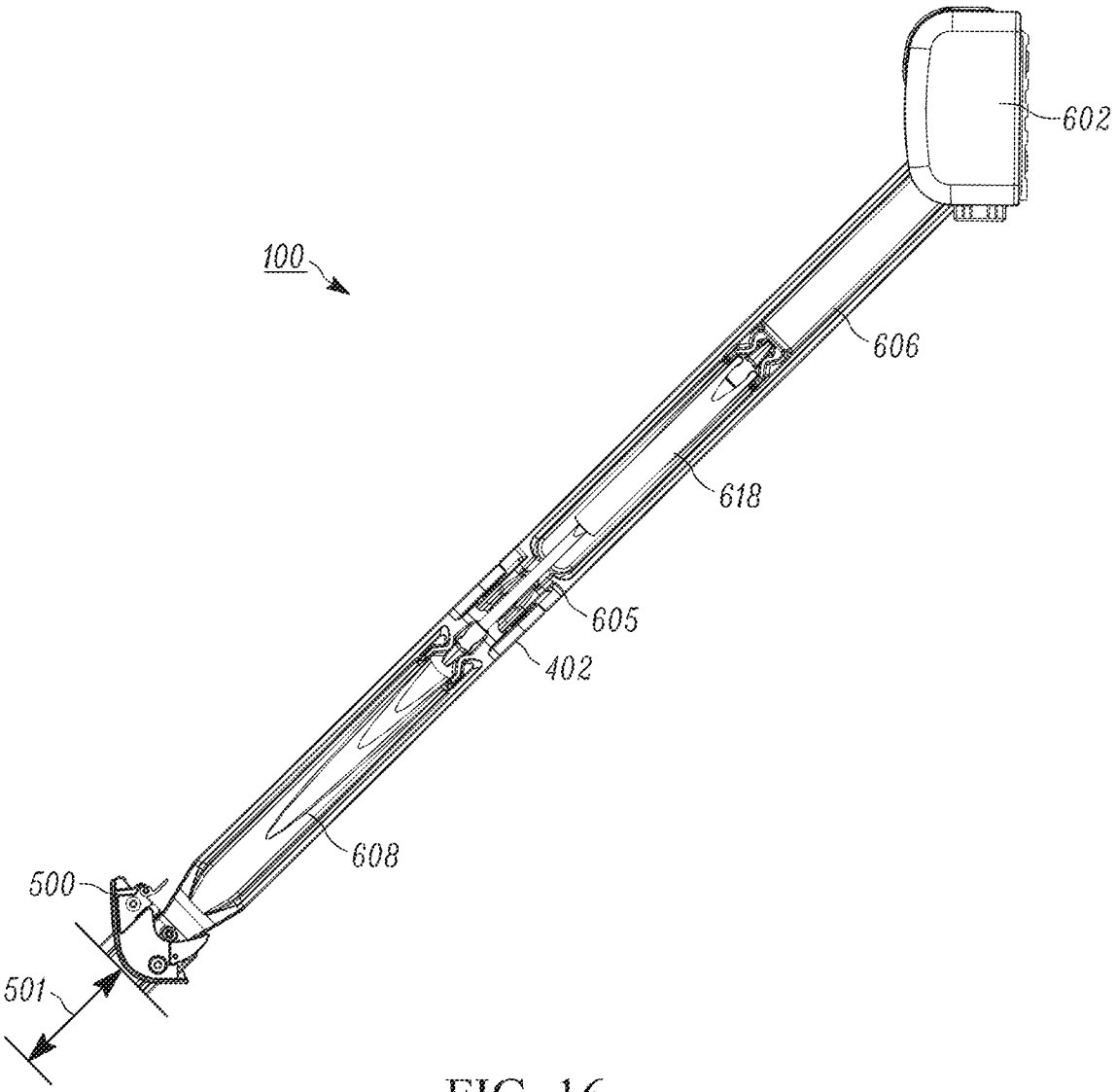
FIG. 16 is a left side view of the awning assembly of FIG. 13 wherein spring arms have been adjusted to a new canopy length.

As soon as the wind gust terminates, as illustrated in FIG. 15, the canopy 402 will have excessive slack due to the partial collapse of the spring arm assemblies 600. Due to the force exerted by the gas springs 618, the spring arm assemblies 600 will naturally begin to move toward the extended position to take up the slack of the canopy 402. However, because the gas springs 618 are damped, movement of the spring arm assemblies 600 is relatively slow and the slack of the canopy 402 is not immediately taken up by the movement of the spring arm assemblies 600. Due to the arrangement of the drive assembly 316 the one-way drive mechanism 318 decouples the roll tube 302 from the motor 320, thereby allowing the torsion spring 314 to quickly rotate the roll tube 302 in the winding direction and immediately take up the canopy 402 slack, as illustrated in FIG. 16. Because the extent of the extension of the awning 100 is limited by the length of unrolled canopy 402, the awning 100 will no longer be extended to the position that the awning 100 was in prior to the excessive wind gust, for example the awning will be shortened the collapse distance 501. By combining the operation of the torsion spring 314, the one-way drive mechanism 318, and the motor 320, the canopy 432 can be rolled in much more quickly than using a motor alone. In one example embodiment, the status monitoring system 700 is configured to roll up the canopy 402 only to the extent necessary to eliminate billowing. Further, either the status monitoring system 700 or the inherent billowing protection mechanism described above, will retract the canopy 402 until the amount of canopy exposed no longer billow, either in a single process, such as with the status monitoring system, or in an iterative process, wherein successive billow events shorten the spring arm assemblies 600 until the awning 100 is retracted. Thus, the damage from billow events to the awning 100 is reduced. In one example embodiment, after the billow event, an extension reattempt of the awning 100 will be performed after a billow recovery timeframe (e.g., 20 minutes). Additional billow events restart the billow recovery timeframe. In addition to retraction due to the billow event, the canopy 402 will retract due to detection of a load detected (e.g., snow, ice, and/or rain). For example, if the z value associated with the awning 100 chances more than 5° the a load duration (e.g., 2 seconds) the awning will retract. In one example embodiment, the awning 100 will reattempt to extend after the load duration has elapsed, absent another load detection, which would restart the load duration.

An additional example operating profile of the status monitoring system 700 will now be explained. When it is desired to install or remove the awning 100, it may be desirable to temporarily disable to the motor 320. The user can temporarily disable the motor 320 by placing the awning in installation/removal mode by communicating with the accelerometer 702 via the kinesthetic communication feature. For example, the accelerometer 702 can programmed to recognize that a preset number of knocks (e.g., three (3) to five (5) rapid knocks) in succession indicates that the user wishes to place the awning 100 in installation/removal/calibration mode. In an example embodiment, a knocking pattern is recognized based upon a window of signal characteristics including time and amplitude. For example, a time and amplitude above a certain threshold will be recognized as a defined input. Thus, prior to installation of the awning 100, or any time thereafter, the user can disable the motor 320 by lightly striking the accelerometer 702 and/or the lead rail 500 (e.g., knocking three (3) to five (5) times in succession). Once the awning 100 is installed, the user can again lightly strike the accelerometer 702 three to five times in succession to enable the motor 320 and make the awning ready for use. In one example embodiment, such as when the awning 100 is in the extended position, responsive to a predetermined number of light strikes to one of the motor 320, the lead rail 500, and/or the accelerometer 702, the awning will retract and jog twice (e.g., extending and retracting 1-2 inches) before disabling.

It would be understood by one having ordinary skill in the art that a variety of contacts with the accelerometer 702 could be utilized to indicate the user wishes to place the awning 100 in installation/removal/calibration mode. Additionally, as in one example embodiment, during installation, removal, or calibration of the awning 100, the status monitoring system 700 is instructed by the mobile device and/or home automation system to disable the motor 320, such as by the user selecting an install/removal option. In another example embodiment, the user instructs the mobile device and/or home automation system to enable the motor 320 once installation/removal of the awning 100 is complete. In yet another example embodiment, the awning 100 indicates through a small retraction or extension, or some other noticeable action, that the awning is in an installation/removal/calibration mode, and completes a second noticeable action to indicate that the awning is in an enabled state post installation. In one example embodiment, the awning 100 will "jog" once (e.g., extending and/or retracting 1-2 inches) and then will countdown for a jog time period (e.g., 30 seconds) before beginning calibration. In another example embodiment, the motor will emit a squeal sound at a time interval (e.g., every couple of seconds) and become progressively more frequent the nearer to the time the calibration is beginning. In this embodiment, the squeal is generated by a lower power pulse width modulation (PWM) pulse, which generates an audible feedback. In yet another example embodiment, a countdown to calibration is displayed in the application. In yet another example embodiment, the user enables the awning 100 on the application by selecting calibration on a screen within the application. In this example embodiment, the calibration begins immediately and performs a full extension and retraction of the awning 100. Prior to an awning being calibrated, the application limits the users options to one of calibration, service extend, and/or service retract. The features of the status monitoring system 700 provide many additional functionality aspects beyond those explicitly addressed above. For example, the awning 100 can be programmed to automatically extend in sunny condition and retract at dusk. As another example, the awning 100 can be programmed to extend only as far as necessary to provide a desired level of shade and continually make adjustments to the level of extension of the canopy throughout the day in order to compensate for the position of the sun to maintain the desired level of shade. As yet another example, the accelerometer 702 can be programmed to know the positioning of the spring arm assemblies 600 when the awning is in the fully extended and the fully retracted positions. This permits the elimination of limit switches and the reliance on operation time and motor speed to determine the position of the lead rail, thereby improving awning operation.

The above described awning provides many additional advantages over known awnings. For example, the attachment of the end caps 602, 604 to the terminal ends of the housing 202 and lead rail 502 moves the spring arm assemblies 600 as far out of view from the window as possible, reduces the number of components, simplifies assembly, and reduces cost. As another example embodiment, the anchor 204 mounting system allows for the quick installation and removal of the awning 100 without tools. In yet another example embodiment, the male/female connections 310, 512, 408, 412 of the canopy 402 to the roll tube 302 and lead rail 502 further reduces the number of components and reduces assembly time. As an even further example, the single piece spring 600 arms again reduce components, simplifies assembly, and reduces cost.

In the foregoing specification, specific embodiments have been described. However, one of ordinary skill in the art appreciates that various modifications and changes can be made without departing from the scope of the disclosure as set forth in the claims below. Accordingly, the specification and flames are to be regarded in an illustrative rather than a restrictive sense, and all such modifications are intended to be included within the scope of present teachings.

The benefits, advantages, solutions to problems, and any element(s) that may cause any benefit advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has a . . . ", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one not embodiment the term is defined to be within 10%, in another embodiment within 5%, in another embodiment within 1% and in another embodiment within 0.5%. The term "coupled" as used herein is defined as connected or in contact, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter has in less than all features of a single disclosed embodiment. Thus the following claims are hereby incorporated into the Detailed Description, with each standing on its own as a separately claimed subject matter.

We claim:

1. An awning control system comprising:

an awning and a status monitoring system, the awning comprising at least one of:

a roll bar coupled to a motor;

a canopy coupled to the roll bar and a housing;

the housing configured to be attached to a dwelling;

arms coupled to the roll bar, configured to move the awning between an extended and retracted position; and the roll bar, housed in the housing, coupled to a first end of the canopy and coupled to the motor;

a lead rail coupled to a second end of the canopy, the lead rail movable relative to the housing between the extended position and the retracted position;

an arm assembly comprising the arms, the arm assembly connecting the housing to the lead rail, the arm assembly allowing the lead rail assembly to move between the extended position and the retracted position; and the status monitoring system in contact with and in control of the motor, the status monitoring system comprising:

at least one sensor, the at least one sensor comprising an at least one accelerometer that determines an absolute location of the lead rail and programmed to receive instruction through a first kinesthetic communication to initiate an installation mode and a second kinesthetic communication to initiate a calibration mode based upon a the first and second kinesthetic communications being over a mode duration and a mode amplitude;

a processor coupled to and in communication with the at least one accelerometer and in contact with and in control of the motor, the processor configured to monitor and control an awning position and control a position of the awning between the installation mode and the calibration mode based upon the first and second kinesthetic communications, wherein the calibration mode is different than the installation mode.

2. The awning control system of claim 1, the processor defining the calibration mode, wherein responsive to the first kinesthetic input comprising repetitive physical interaction between three to five iterations over the mode duration and the mode amplitude to the accelerometer, the processor instructs the awning to extend and retract the status monitoring system further comprising a processor configured to monitor and control an awning position and conditions around the awning and control a position of the awning between the extended and retracted positions based upon at least one input of the at least one sensor.

3. The awning control system of claim 2, the processor defining the installation mode, wherein responsive to the first kinesthetic input, the processor instructs the awning to retract and perform an installation indication followed by instructing the awning to enter into the installation mode, the first kinesthetic input different than the second kinesthetic input.

4. The awning control system of claim 3, the processor instructing the motor to enter a disabled mode during at least one of the installation and the removal modes.

5. The awning control system of claim 3, responsive to receiving the second kinesthetic input, the processor initiates the calibration mode wherein the lead rail is moved between the retracted position, into the extended position and then back to the retracted position, the processor instructs the motor to produce a squeal prior to entering into the calibration mode.

6. The awning control system of claim 1, the at least one sensor comprises the at least one accelerometer, a light sensor, a temperature sensor, and a wind speed sensor, the at least one sensor communicating detected information comprising at least one input to a processor during use.

7. The awning control system of claim 6, the processor receiving the at least one input comprising location information from the accelerometer to calibrate an absolute location of the roll bar.

8. The awning control system of claim 6, the processor receiving the at least one input comprising location information from the accelerometer to measure an angular position of the arm assemblies during extension and retraction of the awning creating an operation profile based upon the movement of the awning between the retracted and the extended positions to calibrate an absolute location of the roll bar.

9. The awning control system of claim 8, the at least one input comprising identifying obstructions, wherein the location of the obstruction is stored by the processor and the motor is instructed by the processor to extend or retract to avoid impact with the identified obstruction.

10. The awning control system of claim 1, the status monitoring system further comprising a transceiver for at least one of sending said detected information to a user on a secondary device and receiving executable instructions about the extension or retraction of the awning from said secondary device.

11. The awning control system of claim 1, the accelerometer coupled to the roll bar to measure a number of rotations of said roll bar to detect movement of the awning and generating a record of the location of the lead rail.

12. A method of operating an awning control system, the method comprising:

providing first and second articulating arms at separate lateral locations, wherein the first and second articulating arms are configured to be mounted via first ends of the first and second articulating arms to a support surface;

providing a lead rail having spaced lateral ends providing a connection to second ends of said first and second articulating arms;

supporting a canopy between said lead rail and a roll bar, coupling the canopy to the roll bar housed within a housing; and coupling a status monitoring system to at least one of the housing and the roll bar, the status monitoring system comprising a processor, a motor, and at least one sensor comprising an accelerometer, the processor for receiving at least one input from the at least one sensor and in contact with and in control of the motor, the motor coupled to the roll bar causing the lead rail assembly to move the awning between an extended and retracted position responsive to instruction received from the processor; and defining an installation mode, wherein the processor disables the motor based upon instructions received through kinesthetic communication comprising one or more distinct kinesthetic inputs comprising a series of applications of direct physical force over a mode duration and a mode amplitude.

13. The method of claim 12, wherein coupling at least one sensor to the at least one of the housing and the role roll bar comprising coupling the accelerometer to the roll bar to measure a number of rotations of said roll bar to detect movement of the awning and generating a record of the location of the lead rail and to receive the one or more distinct kinesthetic inputs.

14. The method of claim 12, wherein coupling at least one sensor comprising coupling at least one of an accelerometer, a light sensor, a temperature sensor, and a wind speed sensor to at least one of the housing or the roll bar, the at least one sensor communicating detected information comprising the at least one input to the processor during use.

15. The method of claim 14, the wherein coupling the status monitoring system to at least one of the housing and the roll bar comprising coupling a transceiver for at least one of sending said detected information to a user on a secondary device and receiving executable instructions about the extension or retraction of the awning from said secondary device.

16. The method of claim 12, comprising configuring the processor to receive the at least one input to calibrate an absolute location of the roll bar, wherein the at least one input comprises location information from the accelerometer of the at least one sensor.

17. The method of claim 12, comprising configuring the processor to receive location information from the accelerometer to measure an angular position of the lead rail during extension and retraction of the awning creating an operation profile based upon the movement of the awning between the retracted and the extended positions to calibrate an absolute location of the roll bar.

18. The method of claim 12, comprising configuring the processor to receive the at least one input comprising identifying obstructions, wherein the location of the obstruction is stored by the processor and the motor is instructed by the processor to extend or retract to avoid impact with the identified obstruction.

19. The awning control system of claim 12, further comprising initiating the installation mode responsive to a first kinesthetic input of the one or more kinesthetic inputs over the mode duration and the mode amplitude to the accelerometer, the first kinesthetic communication comprising a series of application of direct force in a first pattern, the initiating the installation mode comprising instructing the awning to retract and perform an installation indication followed by instructing the awning to enter into the installation mode.

20. The awning control system of claim 19, further comprising initiating calibration mode wherein the motor is activated responsive to a second kinesthetic input of the one or more kinesthetic inputs over the mode duration and the mode amplitude to the accelerometer, the second kinesthetic communication comprising a series of application of direct force in a second pattern, the second pattern different than the first pattern, the initiating the calibration mode comprising instructing the awning to perform an extension and retraction of the lead rail.

21. An awning control system comprising:

an awning comprising:

a roll bar coupled to a motor;

a canopy coupled to the roll bar and a housing;

the housing configured to be attached to a dwelling;

arms coupled to the roll bar, configured to move the awning between an extended and retracted position; and the roll tube, housed in the housing, coupled to a first end of the canopy and coupled to the motor;

a lead rail coupled to a second end of the canopy, the lead rail movable relative to the housing between the extended position and the retracted position; and an arm assembly comprising the arms, the arm assembly connecting the housing to the lead rail, the arm assembly allowing the lead rail assembly to move between the extended position and the retracted position; and a status monitoring system comprising:

a processor configured to monitor an awning position and conditions around the awning and control a position of the awning between the extended and retracted positions base upon at least one input;

at least one sensor wherein the at least one sensor comprises at least one of an accelerometer, a light sensor, a temperature sensor, and a wind speed sensor, the at least one sensor communicating detected information comprising the at least one input to the processor during use, the processor programmed to receive instruction through kinesthetic communication received from the accelerometer to initiate an installation mode responsive to a first kinesthetic input of one or more distinct kinesthetic inputs and a calibration mode responsive to a second kinesthetic input of one or more distinct kinesthetic inputs, the one or more distinct kinesthetic inputs of the first kinesthetic input and the second kinesthetic input comprising a series of two or more direct physical interactions over a mode duration and a mode amplitude, the calibration mode being different than the installation mode;

electric inputs and outputs in electrical communication with the motor, the at least one sensor, and the processor; and a transceiver for at least one of sending said detected information to a user on a secondary device and receiving executable instructions about the extension or retraction of the awning from said secondary device;

defining a first temperature sensitivity mode wherein, responsive to the temperature sensor detecting a temperature over a temperature sensitivity threshold, extending the lead rail toward the extended position until the temperature sensor detects the temperature intensity is under the temperature sensitivity threshold; and defining a first light sensitivity mode wherein, responsive to the light sensor detecting a light intensity over a light sensitivity threshold, extending the lead rail toward the extended position until the light sensor detects the light intensity is under the light sensitivity threshold.

* * * * *